US006374528B1

(12) United States Patent
Davis et al.

(10) Patent No.: US 6,374,528 B1
(45) Date of Patent: Apr. 23, 2002

(54) STOCK AND KIT FOR ACCOMMODATING MOUNTING ON A PLURALITY OF DIFFERENT FIREARMS

(75) Inventors: Michael Aaron Davis, 3028 Tim Tam Trail, Versailles, KY (US) 40383; Larry Everett Moore, Cottonwood, AZ (US)

(73) Assignee: Michael Aaron Davis

( * ) Notice: Subject to any disclaimer, the term of this patent is extended or adjusted under 35 U.S.C. 154(b) by 0 days.

(21) Appl. No.: 09/511,564

(22) Filed: Feb. 23, 2000

(51) Int. Cl.[7] ..... F41A 17/00
(52) U.S. Cl. ..... 42/71.01; 42/75.03; 42/73
(58) Field of Search ..... 42/71.01, 75.03, 42/73

(56) References Cited

U.S. PATENT DOCUMENTS

| | | | | | |
|---|---|---|---|---|---|
| 210,626 | A | * | 12/1878 | Perry | 42/75.03 |
| 1,755,034 | A | * | 4/1930 | Stange | 42/75.03 |
| 2,368,160 | A | * | 1/1945 | Roemer | 42/75.01 |
| 2,447,091 | A | * | 8/1948 | Pope | 42/75.03 |
| 3,323,246 | A | * | 6/1967 | Loffler | 42/75.03 |
| 3,488,488 | A | * | 1/1970 | Crouch | 42/75.03 |
| 4,290,220 | A | | 9/1981 | Ruger | 42/75 |
| 4,512,101 | A | | 4/1985 | Waterman, Jr. | 42/71 |
| 4,654,993 | A | | 4/1987 | Atchisson | 42/71.01 |
| 4,663,876 | A | | 5/1987 | Reaume | 42/71.01 |
| 4,674,216 | A | | 6/1987 | Ruger et al. | 42/71.01 |
| 5,020,260 | A | * | 6/1991 | Houghton | 42/75.03 |
| 5,075,995 | A | | 12/1991 | Kennel | 42/73 |
| 5,142,806 | A | | 9/1992 | Swan | 42/101 |
| 5,392,553 | A | | 2/1995 | Carey | 42/73 |
| 5,590,486 | A | | 1/1997 | Moore | 42/103 |
| 5,864,978 | A | | 2/1999 | McRary et al. | 42/71.01 |
| 5,907,918 | A | | 6/1999 | Langevin et al. | 42/71.01 |

* cited by examiner

*Primary Examiner*—Peter M. Poon
*Assistant Examiner*—Denise J Buckley
(74) *Attorney, Agent, or Firm*—David E. Rogers; Stuart A. Whittington; Squire Sanders & Dempsey L.L.P.

(57) ABSTRACT

An adaptor kit for mounting a stock on a firearm receiver having any one of a plurality of different configurations. The kit includes one or both of a rear stock and a fore-stock and a set of front and/or rear adaptors that enable the rear and/or fore-stock to be interchangeably mounted on the differently configured firearm receivers so that the mounted stock and receiver meets predetermined design parameters including finger pull, shoulder pull and drop parameters.

25 Claims, 21 Drawing Sheets

62
64
60
66
50
52
54
58
56
800
900
102
108
116
120
104
112
10
116
227
100
210
206
204
208
124
122

2000
1600
1800
1500
2200

1700
1900
2100
800
900
102
136
134
132
1002
1000

2000
1600
1800
1500
1200
1700
1900
2100

STOCK AND KIT FOR ACCOMMODATING MOUNTING ON A PLURALITY OF DIFFERENT FIREARMS

BACKGROUND OF THE INVENTION

The present invention relates to firearm, e.g., shotgun stocks and adapter kits for mounting the stock on a plurality of different firearm receivers.

It may be necessary or desirable to replace the buttstock or fore-stock of a firearm, such as a shotgun, for a variety of reasons. In general, replacement stocks for firearms are well known. Examples of gun stocks are described in U.S. Pat. Nos.: 4,290,220 issued on Sep. 22, 1981 to Ruger; U.S. Pat. No. 4,512,101 issued on Apr. 23, 1985 to Waterman Jr.; U.S. Pat. No. 4,654,993 issued Apr. 7, 1987 to Atchisson; U.S. Pat. No. 4,663,876 issued on May 12, 1987 to Reaune; U.S. Pat. No. 4,674,216 issued Jun. 23, 1987 to Ruger et al.; U.S. Pat. No. 5,075,995 issued Dec. 31, 1991 to Kennel; U.S. Pat. No. 5,392,553 issued to Feb. 28, 1995 to Carey; U.S. Pat. No. 5,864, 978 issued Feb. 2, 1999 to McRary et al.; U.S. Pat. No. 5,907,918 issued Jun. 1, 1999 to Langevin et al.

The receivers of different types of firearms tend to be different, and replacement stocks are typically made for a specific single firearm. More specifically, it is desirable that the relative disposition of the buttstock and receiver meet certain design parameters with respect to: "shoulder pull," the distance between the butt pad and trigger; "finger pull," the distance between the the trigger and point on the stock where the web of the shooter's hand (between thumb and index finger) rests; and "drop," the distance from the top of the receiver to the comb piece (position on the stock where the shooter places his or her cheek to take a sight picture). However, a number of relevant parameters tend to vary between different types and models of firearms, including: the contour and angles of the portion of the receiver that mates with the buttstock and/or fore-stock (also sometimes referred to as a fore end or fore end stock), and distance from the end of the receiver to the trigger; the length, disposition and/or angle of the fastening mechanism (e.g., threaded screw) used to couple the buttstock; and the configuration of the mechanism that couples the fore-stock to the receiver. Accordingly, a buttstock or fore-stock designed to accommodate a particular type and model of receiver generally cannot accommodate other receivers and still conform to the various desired design parameters.

The necessity of maintaining different replacement stocks for each of a number of firearms in inventory is expensive and otherwise burdensome, and consequently, replacement stocks for a given firearm are often not readily available.

In general, mounts for accommodating a plurality firearm accessories or mounting a particular accessory on a plurality of firearms are known. For example, a universal receiver sleeve is described in U.S. Pat. No. 5,142, 806 issued to Swan on Sep. 23 1991, and a mount for a laser sight capable of accommodating trigger guards of plurality of different configurations is described in U.S. Pat. No. 5,590, 486 issued to Moore on Jan. 7 1997.

However, there remains a need, for a replacement stock kit that can cooperate with, and maintain the desired design parameters, for a plurality of different receiver configurations.

SUMMARY OF THE INVENTION

In one aspect, the present invention provides, an adapter kit for mounting a stock on a firearm receiver having any one of a plurality of different configurations. The kit comprises: at least one of a rear stock and a fore-stock. Each rear stock, if any, includes a forward portion having a predetermined configuration and has at least one front adapter associated therewith. The front adapter includes a rearward portion conforming to the stock forward portion predetermined configuration and a forward portion conforming to an associated one of the plurality of different receiver configurations, such that, when the rear stock is disposed with the stock forward portion adjacent the rearward portion of the adapter, and the adapter forward portion is disposed adjacent the rear surface of a receiver of the configuration associated with the adapter, the relative disposition of the rear stock and receiver is in accordance with predetermined design parameters (e.g., trigger pull, shoulder pull, and drop). Each fore-stock, if any, includes a forward portion having a predetermined configuration and a rear portion having a predetermined configuration, and at least one set of front and rear fore stock adapters. The front fore stock adapter includes a rearward portion conforming to the fore stock forward portion predetermined configuration and a forward portion conforming to an associated one of the plurality of different receiver configurations. The rear fore stock adapter includes a forward portion conforming to the fore stock rear portion predetermined configuration and a rearward portion conforming to the associated receiver configuration.

In accordance with another aspect of the present invention, the kit includes first and second front adapters. Each of the front adapter's includes a rearward portion conforming to the stock forward portion predetermined configuration and a forward portion conforming to an associated one of the plurality of different receiver configurations. The forward portion of the first front adapter, includes a generally flat surface, with a peripheral recess, the recess having a rear wall and side walls, a passageway opening in the flat surface; and a slot formed through side walls and rear wall of the recess. The forward portion of the second front adapter includes a front surface, effectively defined by two planes intersecting along a line and a passageway having an opening disposed on the line of intersection.

BRIEF DESCRIPTION OF THE DRAWING

The preferred exemplary embodiment of the present invention will hereinafter be described in conjunction with the appended drawing, where like designations denote like elements, and.

DETAILED DESCRIPTION OF A PREFERRED EXEMPLARY EMBODIMENT

Figures 1A, 1B, 1C, 1D:
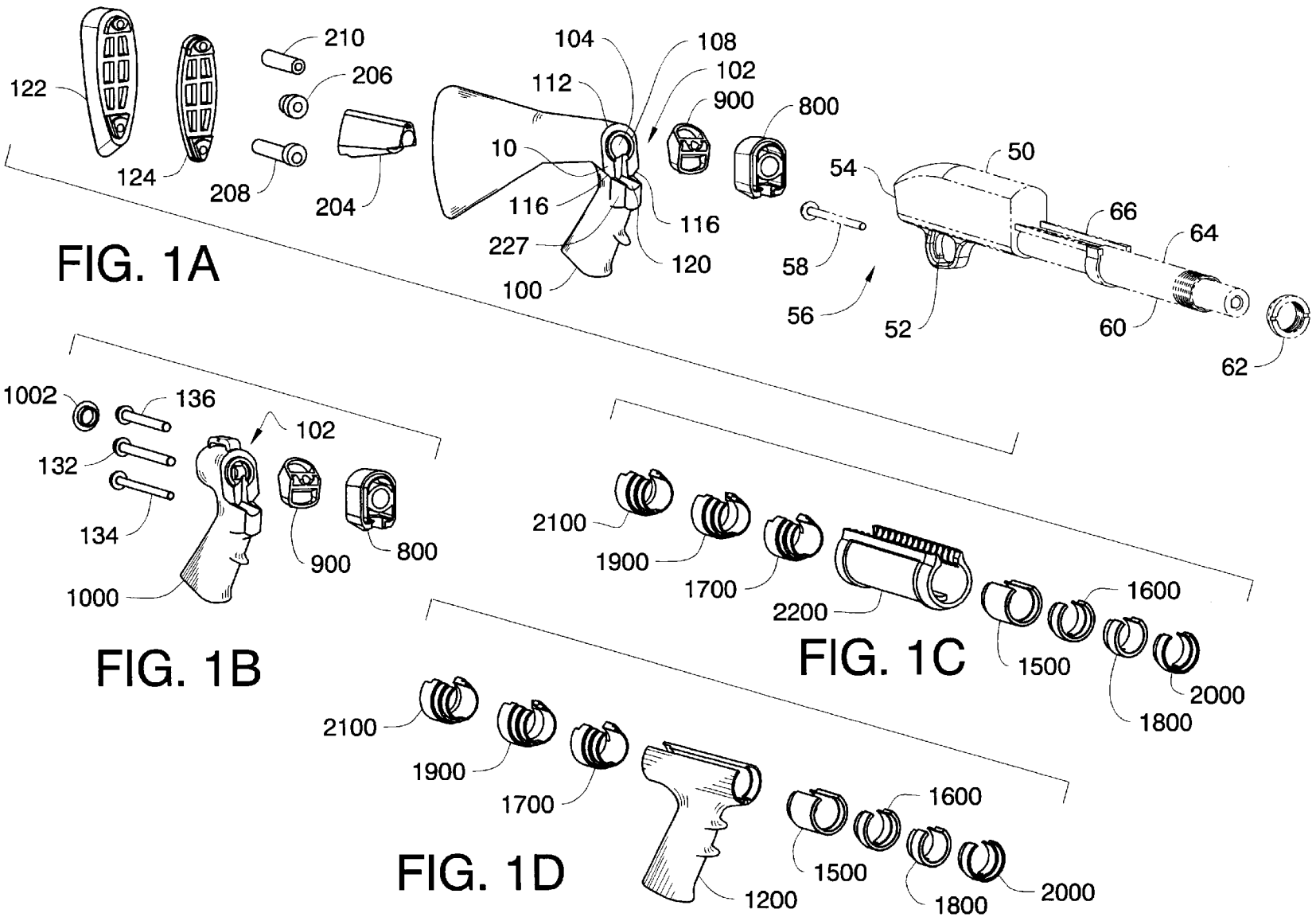
FIGS. 1*a*–1*d* (collectively referred to as FIG. 1) are exploded perspective views of stock replacement kits in accordance with the present invention.

With reference to FIG. 1*a*, a conventional firearm, e.g., shotgun, receiver 50 typically includes: a trigger 52; a rear surface; and a mechanism 56 for securing the buttstock to the receiver. In many instances the firearm also includes: a magazine 60; a removable (typically threaded) end nut 62; and a forward extending cocking mechanism including, in the case of a pump shotgun, a cocking slide 64, typically generally tubular and often referred to as a slide tube; and respective action bars 66. Surface 54 is disposed a predetermined distance to the rear of trigger 52 and presents a predetermined contour for mating with the front of a buttstock. Securing mechanism 56 typically comprises a receptacle, e.g. threaded bore (not shown), in surface 54 cooperating with an elongated fastener, e.g. a bolt, 58. Bolt 58, when threaded into the bore, extends rearwardly from surface 54 at a predetermined angle (typically perpendicular to the portion of surface 54 in the vicinity of the bore) for predetermined distance. In assembly, bolt 58 is journaled through a bore in the interior of the buttstock and threaded into the bore in surface 54 to secure the buttstock to the receiver.

In general, a fore-stock is fastened to and over the magazine and/or cocking mechanism components. For example, the stock fore-stock of a pump shotgun is typically fastened to slide 64, partially surrounding slide 64 and held in place by action bars 66 at the rear and by end nut 62 in the front. End nut 62 typically threads onto the end of slide 64.

As previously noted, the contour and angles of surface 54, the distance from surface 54 to the trigger, and the length, disposition and/or angle of fastening mechanism 56 typically varies between different types and models of firearms. The diameter of the bolt 58 employed in different types and models of firearms may also differ, typically either ¼ inch or 5/16 inch.

For example, the inventors have determined the majority of shotguns sold in United States employs receivers with rear surfaces 54 having one of three different configurations: the Mossberg, Winchester, and Remington configurations.

Figure 7A:
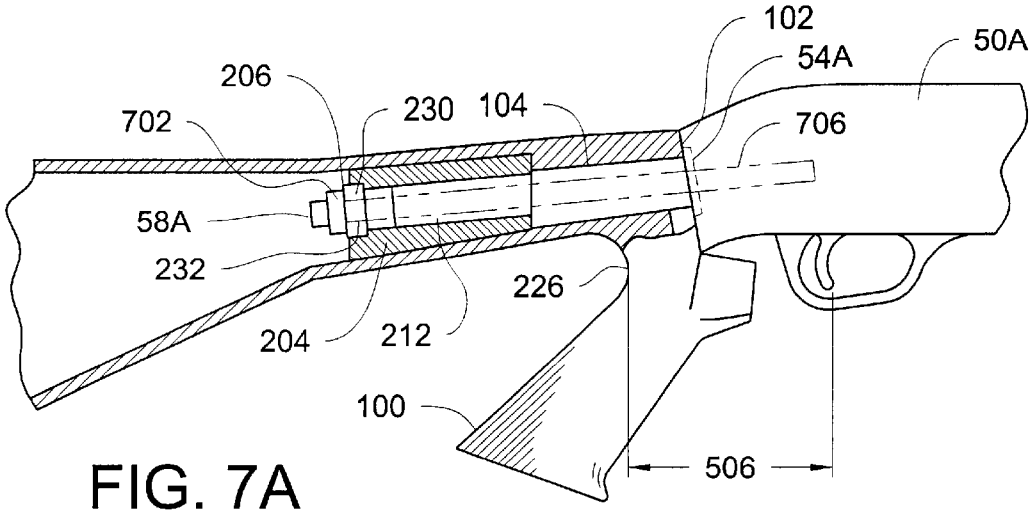
FIGS. 7*a*, 7*b*, and 7*c* (collectively referred to as FIG. 7) are a schematic diagrams illustrating various receiver configurations and fastener dispositions.

The configuration of the Mossberg receiver, illustrated in FIG. 7*a*, generally includes a flat surface 54*a* with a predetermined peripheral shape, an annular recess, an outward going projection, and a threaded hole, for receiving and engaging a bolt, 58*a*. The periphery of surface 54*a* is generally rectangular with a rounded top, a flat bottom with chamfered bottom corners. The rounded top, annular recess, and threaded hole are all generally concentric and the outward going projection extends along the vertical from the top of the annular recess to the flat bottom. In the Mossberg configuration, surface 54*a* is disposed a first predetermined distance rearward of the receiver trigger, and bolt 58*a*, when sufficiently engaged to secure the receiver to the stock, having a first predetermined extension (i.e. extends a predetermined distance) to the rear of the receiver rear surface (into the stock).

Figure 7B:
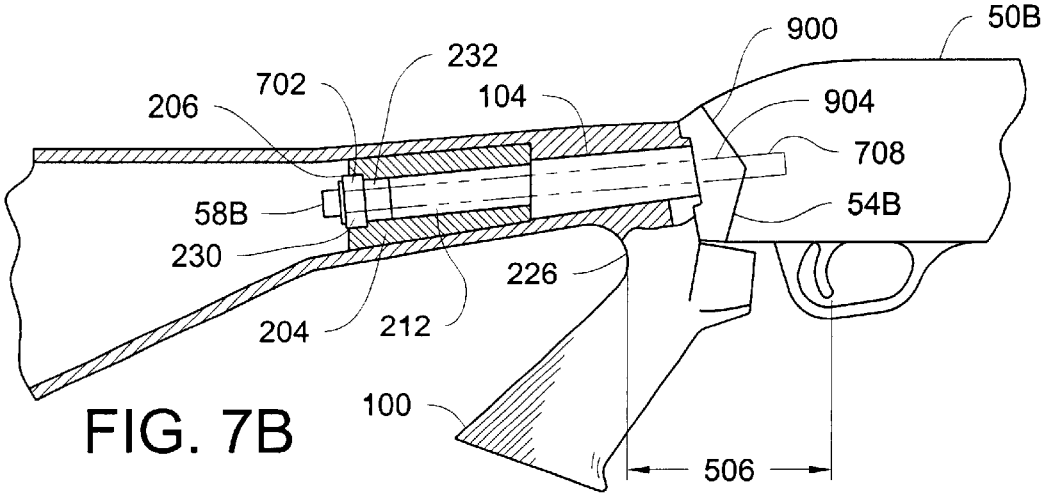

The configuration of the Winchester shotgun receivers, illustrated in FIG. 7*b*, includes a surface 54*b* having a with a predetermined peripheral shape periphery and a threaded hole for receiving a bolt 58*b*. The periphery of surface 54*b* in the Winchester configuration includes a rounded top, and a generally flat bottom, with rounded corners. However, surface 54*b* in the Winchester configuration, in effect comprises two planes angling forward (toward the trigger) from the top and bottom to intersect along a line at a nadir; when viewed from the side, recedes from the top and bottom to a nadir at the center (i.e. V's in). The threaded hole for receiving bolt 58*b* is provided in the center of the line between the nadir points of the sides. The Winchester configuration has a substantially the same width, but is of slightly greater height than the Mossberg configuration. In the Winchester configuration, surface 54*b* (at top and bottom) is disposed closer to the trigger, than surface 54*a* in the Mossberg configuration, and bolt 58*b*, when sufficiently engaged to secure the receiver to the stock, extends farther into the stock greater than bolt 58*a* in the Mossberg configuration.

Figure 7C:
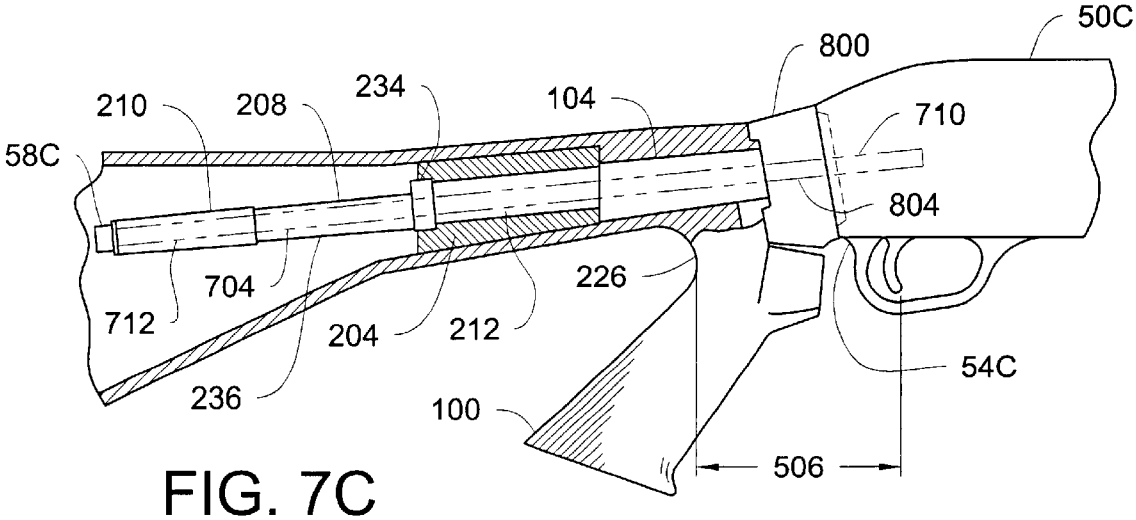

The configuration of the Remington shotgun receiver, illustrated in FIG. 7*c*, includes a surface 54*c* and original bolt 58*c*. Surface 54*c* manifests substantially the same general peripheral configuration as surface 54*a* in the Mossberg configuration, and has substantially the same width, but is of greater height. A projection similar to that in the Mossberg configuration is also provided. However, in the Remington configuration, surface 54*c* has the nature of a peripheral lip, and defines an interior recess generally conforming in shape to the peripheral configuration (rather than an annular ring as in the Mossberg configuration). In the Remington configuration, surface 54*c* is somewhat closer to the receiver trigger than in either the Mossberg or Winchester configurations, and bolt 58*c*, when sufficiently engaged to secure the receiver to the stock, extends a greater distance into the stock than in either the Mossberg or Winchester configuration. In addition, the hole for receiving bolt 58*c* is disposed a greater distance from the top of the receiver than is the case in the Mossberg or Winchester configurations. Accordingly, if stock 100 is disposed to provide the desired drop parameter for a Remington configuration receiver, the disposition of bolt 58 is offset downwardly when compared to the Mossberg configuration. In addition, bolts of different lengths are employed with the Remington configuration.

In general, the stock fore-stock is fastened to and over the magazine and/or cocking mechanism components of receiver 50. For example, the stock fore-stock of a pump shotgun is typically fastened to slide 64, partially surrounding slide 64 and held in place by action bars 66 at the rear and end nut 62 in the front. As previously noted, the configuration of the mechanism that couples the fore-stock to the receiver also tends to vary between different types and models of firearms. For example, the majority of pump shotguns sold in United States employ receivers having one of four different magazine/cocking mechanism configurations. The slide tubes tend to vary in diameter and length. For example, Mossberg slides are of a first predetermined diameter and of either a first (longer) or second (shorter) predetermined length. More specifically, older style Mossberg slides are of the first (longer) length, and newer style Mossberg slides are of the second (shorter) predetermined length. Winchester is of a second predetermined diameter, less than the diameter of the Mossberg slides and of a third predetermined length, shorter than the newer style Mossberg slides. Remington slides are of a third predetermined diameter, approximately equal to the second predetermined diameter, and of a fourth predetermined length, approximating the third predetermined length.

Referring now to FIGS. 1*a*–1*d*, a kit in accordance with the present invention suitably comprises one or more rear stocks, such as buttstock 100 (FIG. 1*a*) and/or pistol grip stock 130 (FIG. 1*b*); and/or one or more fore-stocks, such as standard fore-stock 150 and/or pistol grip fore-stock 180; together with one or more sets of adapters for matching the rear stock(s) and/or fore-stock(s) stock to a receiver 50 having any one of a plurality of different configurations. Each set of adapters is associated with a particular receiver configuration. In the preferred embodiment, the rear stocks are suitably each configured to fit a first receiver configuration, and the respective adapters provided to fit the rear stock(s) and/or fore-stock(s) to different receiver configurations.

For example, as illustrated in FIG. 1*a*, the kit may include rear buttstock 100, in combination with a predetermined number (e.g., 2) of respective front adapters 800 and 900 (each associated with a particular receiver configuration), an internal rear platform 204, a predetermined number (e.g., 3) of respective rear adapters 206, 208 and 210 (associated singlely, or in combination, with one or more configurations), a butt pad 122, and, if desired, one or more shoulder pull adjustment spacers 124. Buttstock 100 can be secured to any one of a set of receiver configurations, (e.g., 50*a*, 50*b*, or 50*c*) by: interposing the appropriate front adapter adapter (800, 900) between the front of the stock and receiver rear surface 54; disposing platform 204, and appropriate a rear adapter(s) (206, 208, 210) within the interior of stock 100; journaling the original bolt 58 through passageways in the rear adapter(s) (206, 208, 210), platform 204, stock neck and front adapter (800, 900), into alignment with a corresponding threaded hole in the rear surface 54 of the receiver 50; and threading bolt 58 into the threaded hole.

As will be more fully explained, the orientation of the rear adapter relative to the platform can be varied to accommodate more than one receiver configuration with a single rear adapter. For example, depending upon orientation, rear adapter 206, in cooperation with platform 204, facilitates securing stock 100 to e.g., Mossberg shotgun configuration 54*a* or .e.g., (in combination with front adapter 900) Winchester shotgun configuration 54*b*, in each case employing the original bolt provided with the receiver. Likewise, rear adapters can be used in combination to accommodate different receiver configurations. For example, rear adapter 208 (in cooperation with platform 232 and front adapter 800), facilitates securing stock 100 to, e.g., a Remington shotgun employing an original bolt 58 of a first length, and in further combination with adapter 210, e.g., a Remington shotgun employing an original bolt 58 of a second length. Suitable adapter combinations are summarized in Table 1.

TABLE 1

| Rear stock Receiver Configuration | Rear Adapter | Front Adapter |
|---|---|---|
| Mossberg | 206 (extension. forward) | none |
| Winchester | 206 (extension rearward) | 900 |
| Remington, (shorter screw) | 208 (extension rearward) | 800 |
| Remington, (longer screw) | 208 (extension rearward); 210 | 800 |

If desired, the plurality of rear adapters could be omitted in favor of a slotted washer and respective substitute bolts (not shown), each corresponding in diameter and thread to the bolt 58 of an associated receiver configuration, but of a length adjusted such that the rearward extension into the interior of stock 100 is the same for each of the accommodated configurations. Rear adapters are employed in the preferred embodiment, as the less-expensive alternative.

Alternatively (or additionally), as illustrated in FIG. 1*b*, the kit may include rear pistol grip 1000, in combination with front adapters 800 and 900, a predetermined number of respective bolts 132, 134, and 136 (each corresponding in diameter and thread to the bolt 58 of an associated receiver configuration, and of a length in accordance with the associated receiver configuration), and an end cap 1002. The configurations of buttstock 100 and rear pistol grip stock 1000 are such that the same front adapters, e.g., 800 and 900, can be employed for both. Accordingly, a kit including both buttstock 100 and rear pistol grip 1000 would suitably include only one each of the respective front adapters. Bolts 132, 134, and 136 are substituted for the standard bolts 58 of the receiver configurations to be accommodated, and employed to secure rear pistol grip 1000 to the associated receivers. No rear adapters are necessary.

Further, the kit may (alternatively or additionally) include, as illustrated in FIG. 1*c*, a standard fore-stock 2200 in combination with a predetermined number of respective front adapters 1500, 1600, 1800 and 2000, and respective rear adapters 1700, 1900 and 2100. Various combinations of rear adapters 1700, 1900, and 2100 and front adapters 1500, 1600, 1800 and 2000, correspond to respective receiver configurations, and adapt fore-stock 2200 to fit those receiver configurations. For example, the combination of rear adapter 1700 and front adapter 1500, the combination of rear adapter 1700 and front adapter 1600, the combination of rear adapter 1900 and front adapter 1800, and the combination of rear adapter 2100 and front adapter 2000 each correspond to a different receiver configuration. Suitable adapter combinations for various configurations of pump shotgun fore-stocks are summarized in Table 2.

TABLE 2

| Fore-stock Receiver Configuration | Rear Adapter | Front Adapter |
|---|---|---|
| Mossberg, (old-style) | 1700 | 1500 |
| Mossberg, (new -style) | 1700 | 1600 |
| Winchester | 1900 | 1800 |
| Remington | 2100 | 2000 |

Likewise, the kit may (alternatively or additionally) include, as illustrated in FIG. 1*d*, a pistol grip fore-stock 1200 in combination with front adapters 1500, 1600, 1800 and 2000, and rear adapters 1700, 1900 and 2100. The configurations of buttstock 100 and rear pistol grip stock 1000 are such that the same front adapters, e.g., 1500, 1600, 1800 and 2000, and rear adapters e.g., 1700, 1900 and 2100, can be employed for both. Accordingly, a kit including both standard fore-stock 2200 and pistol grip fore-stock 1200 would suitably include only one each of the respective adapters As will be more fully explained, buttstock 100 and rear pistol grip 1000 each includes a forward portion 102 having a predetermined configuration. Front adapters 800 and 900 adapt stock 100 to fit their respective associated receiver configurations, such that stock 100 still conforms to the desired shoulder pull, finger pull, and drop design parameters. Adapters 800 and 900 each include rearward portions (801, 901) conforming to the configuration of stock forward portion 102 and forward portions (803,903) conforming to the configuration of the receiver associated with the particular adapter. Adapters 800 and 900 will be more fully described in conjunction with FIGS. 8 and 9. Preferably, stock forward portion 102 is itself configured to conform to an associated receiver configuration (e.g., the particular configuration having the greatest distance between rear surface 54 and trigger 52 of the set of configurations to be accommodated), such that the desired shoulder pull, finger pull, and drop design parameters are met for that receiver configuration without a separate adapter. Alternatively, the configuration of stock forward portion 102 may not correspond to any particular receiver configuration, but is such that an adapter for the receiver configuration having the longest distance between rear surface 54 and trigger 52 can be accommodated.

As will also be more fully explained, variations in the mechanisms 56 employed to fasten the rear stock to the different receiver configurations are accommodated. To this end, adapters 800 and 900 include apertures (804, 904) in accordance with the diameter, angle and disposition of bolt 58 in the corresponding receiver configuration, and stock forward portion 102 includes an passageway 104 of dimensions capable of accommodating each of the particular bolt diameters, angles, and dispositions employed by the various receiver configurations. As will also be farther described, platform 204, is received within the interior of buttstock 100, and includes a passageway 212 of predetermined dimensions. Platform 204, typically in combination with one of rear adapters 704, 706, and 708, facilitates securing stock 100 to receiver 50 employing the original bolt 58 associated with the various configurations of receiver 50 notwithstanding variations in length, diameter and disposition of the original bolts 58 provided with the receivers.

More specifically, referring to FIGS. 1*a*, 2–5, and 7 buttstock 100 suitably includes: an interior compartment 202; a rear edge 220 (adapted to mate with butt pad 122, and/or pull adjustment spacers 124); a neck 222, and a pistol grip 224 having a grip neck 226 and forward extending portion 227. Neck 222 suitably includes passageway 104 of predetermined axial length, e.g., 2 inches, and terminates in forward surface 102. Passageway 104 communicates with internal compartment 202, with a shoulder 228 formed at the juncture thereof. Interior compartment 202 suitably extends rearwardly from shoulder 228, forming a forward area 225 of predetermined configuration immediately rearward of shoulder 228 and terminating in an opening at rear edge 220.

Figure 5:
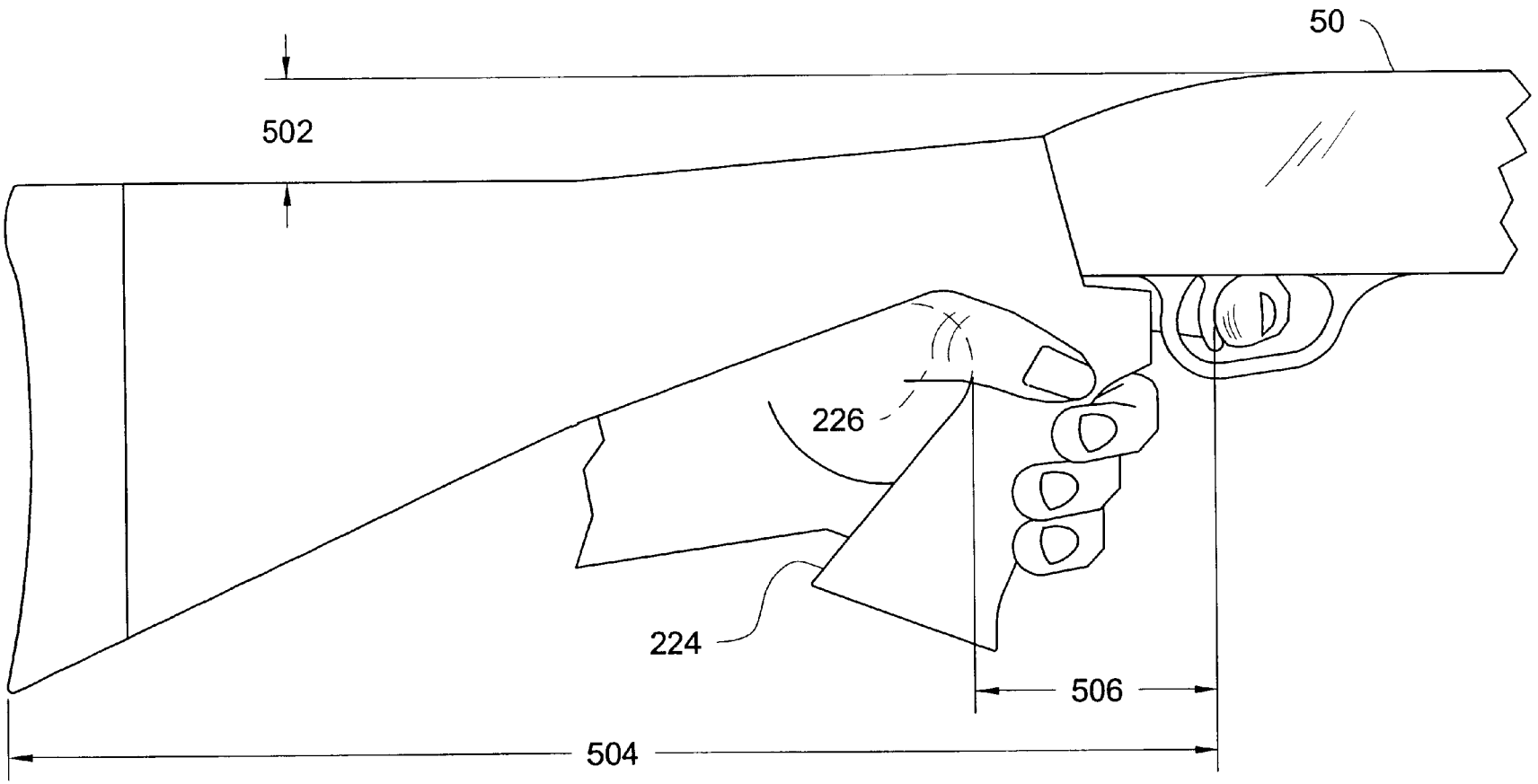
FIG. 5 is a side view of the full-length buttstock and an adapter cooperating with a second receiver configuration.
Figure 6:
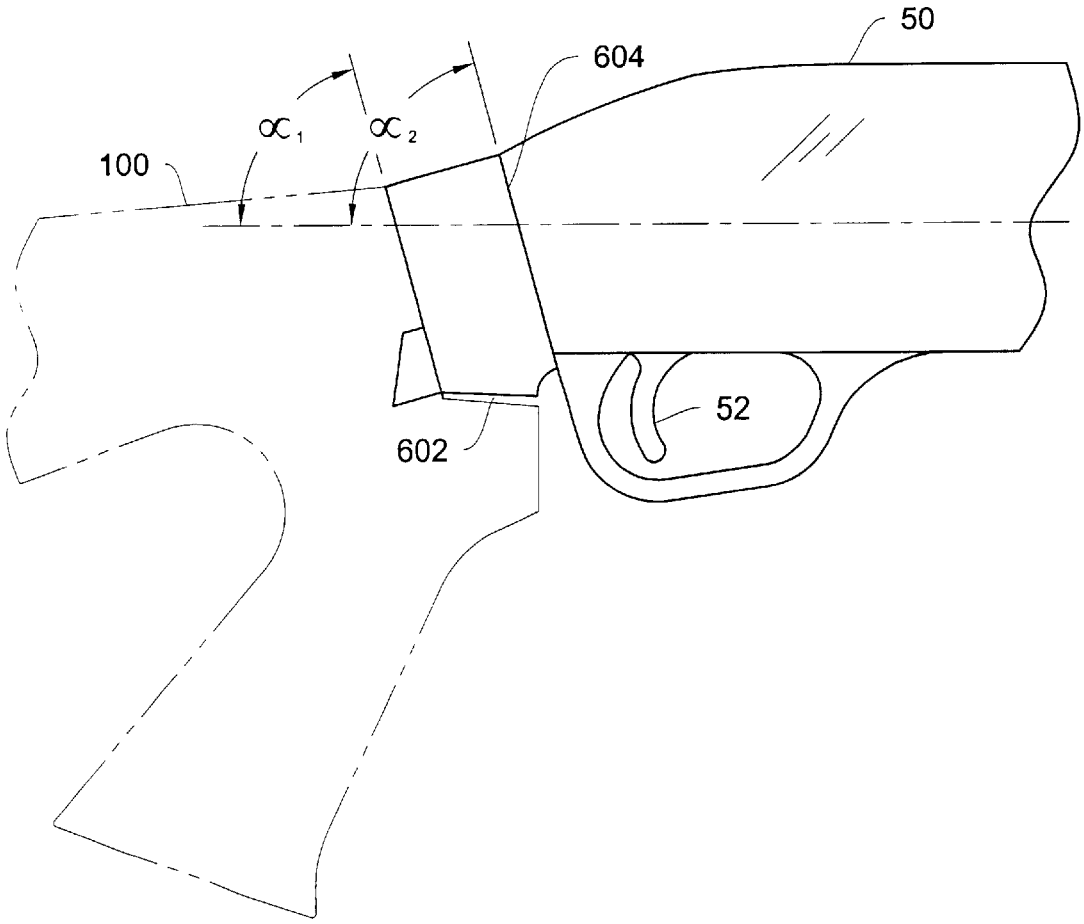
FIG. 6 is a side view of the full-length buttstock of FIG. 1*a* in cooperation with a first receiver configuration extending a relatively long distance rearwardly of the trigger.

As best seen in FIG. 5, in use, with stock 100 secured to a receiver 50, the web of the shooter's hand (between thumb and index finger) rests on pistol grip 224 in the vicinity of grip neck 226. When stock 100 is secured to receiver 50 it is desirable that design parameters are met with respect to: drop 502, shoulder pull 504, and finger pull 506. Drop 502 corresponds to the distance from the top of the receiver to the position on the stock where the shooter places his or her cheek to take a sight picture. In general, it is desirable that the drop be between 1.5 and 2.5 inches, typically 1.75 to 2 inches, and an preferably approximately 1.8 to 1.9 inches. Shoulder pull 504 corresponds the distance between the butt pad and trigger. It is desirable that the distance from butt pad and trigger is such that the tip of the shooter's finger rests on the trigger with the first joint the shooter's knuckle at a ninety degree angle to the trigger. In general, it is desirable that the shoulder pull be between 12 and 16 inches, typically between 13 and 15 inches, and preferably approximately 14 inches. Finger pull 506 corresponds to the distance between the the trigger and grip neck 226 where the web of the shooter's hand rests. It is desirable that the distance from grip neck 226 and trigger is such that the tip of the shooter's finger rests on the trigger with the first joint the shooter's knuckle at a ninety degree angle to the trigger In general, it is desirable that the trigger pull be between 2 and 3 inches, typically be between 2.25 and 2.75 inches, and preferably approximately 2.5 inches. If desired, the drop, shoulder pull, and finger pull parameters can be made to replicate those of the original stocks for the respective receivers. Alternatively, a given set of adapters can be configured to provide drop, shoulder pull and finger pull parameters different from those of the original stock.

As previously noted, platform 204, typically in combination with one of rear adapters 704, 706, and 708, facilitates securing stock 100 to receiver 50 employing the original bolt 58 associated with the various configurations of receiver 50 notwithstanding variations in length, diameter and disposition of the original bolts 58 provided with the receivers. Platform 204 is configured to be received within a forward area 225 of compartment 202, lodging against shoulder 228. The exterior peripheral configuration of platform 204 suitably conforms closely to the interior peripheral configuration of forward area 225 in the vicinity of shoulder 228. Platform 204 suitably includes a passageway 212, with a locating bore (e.g., co-axial larger diameter bore) 214 at the rear end thereof. Passageway 212 of platform 204, is of sufficient diameter to accommodate the various diameters, dispositions and angles of the original bolts 58 employed with the various receiver configurations.

As also previously noted, the distance into the interior of stock 100 which bolt 58 extends when the bolt is securely engaged in the threaded hole of the associated receiver varies between receiver configurations. The length of platform 204 (and particular passageway 212) is chosen such that, in combination with passageway 104, the the rearward end of passageway 212 is approximately co-incident with, or forward of, the shortest of those distances among the receiver configurations to be accommodated. For example, in a stock 100 intended to accommodate Mossberg, Remington, and Winchester pump shotguns, with a neck passageway 104 approximately 2 inches in length, platform 204 suitably includes a passageway 212 having a ½ inch diameter with a locating bore 214 of ¾ inch diameter, and is suitably 2 ⅞ inches long. Passageway 212 is suitably 2 ¾ inches long, and locating bore 214 ⅛ inch deep. Platform 204, typically in combination with one or more of rear adapters 206, 208 and 210, can thus, as best seen in FIG. 7, accommodating the varying lengths of the standard bolts 58 and provide proper thread engagement for attachment to receiver 50. The use of the rear adapters also accommodates the variations in disposition of bolts 58 as between the different receiver configurations.

If desired, under certain circumstances, platform 204 can be made an integral part of stock 100, i.e., passageway 212, and locating bore 214 at the rear end thereof would, in effect be an extension of passageway 104. However, a separate platform 204 is generally preferred, particularly when stock 100 is formed of injection molded plastic. Any suitably hard polymer may be utilized, such as 33 percent glass field filled nylon. A relatively hard material is desirable to prevent compression and movement. Formation of injection molded plastic walls in excess of a certain thickness tends to be susceptible to shrinkage and deformation and difficult to properly cool during the molding process. Accordingly, a separately made platform 204 tends to facilitate proper alignment both between the stock and receiver and between bolt 58 and the corresponding threaded hole in receiver 50, and to ensure secure engagement.

Figure 2:
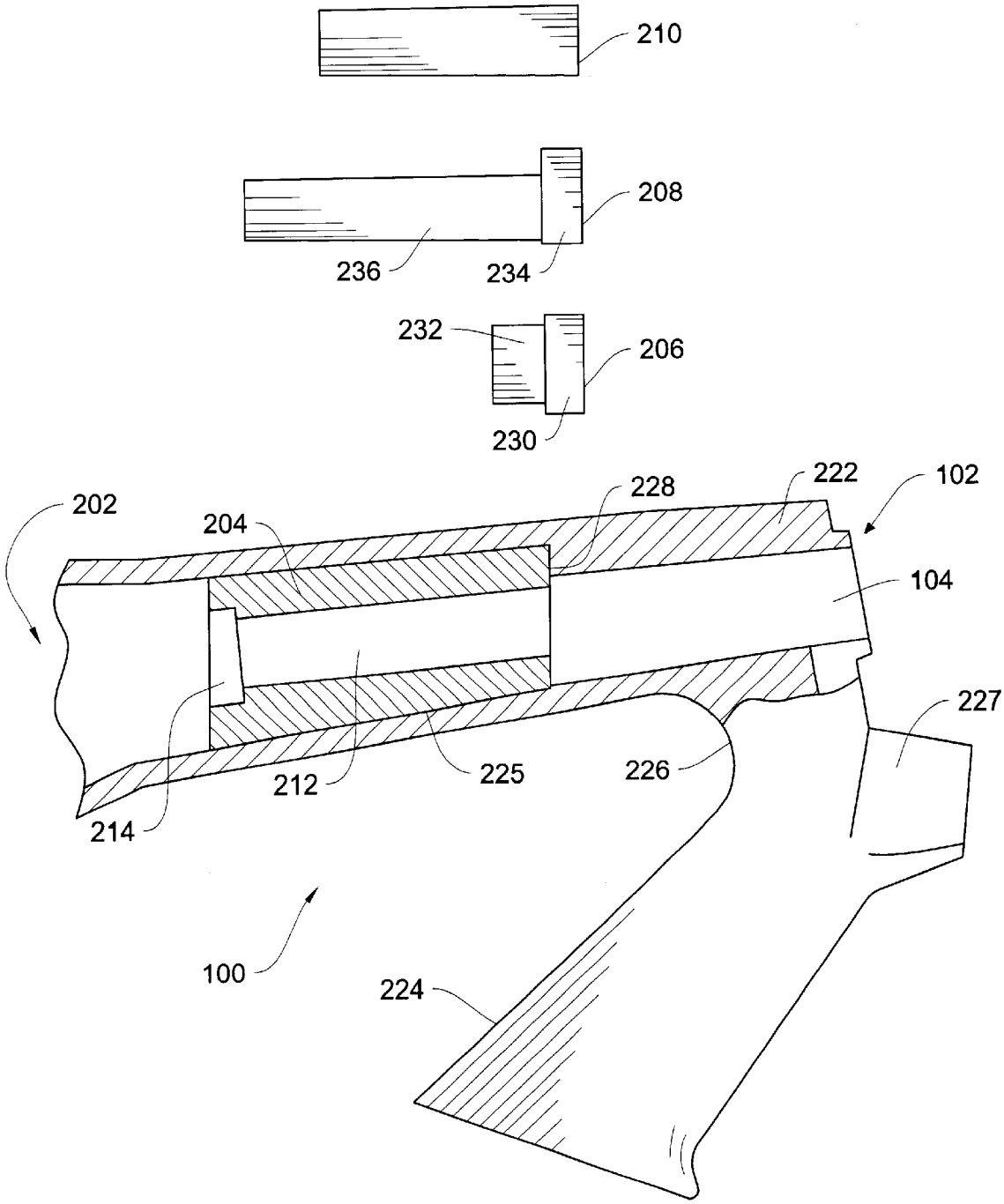
FIG. 2 is a partial sectional view of the fall-length buttstock showing the interior platform and various fastener adapters of FIG. 1*a;*
Figure 3:
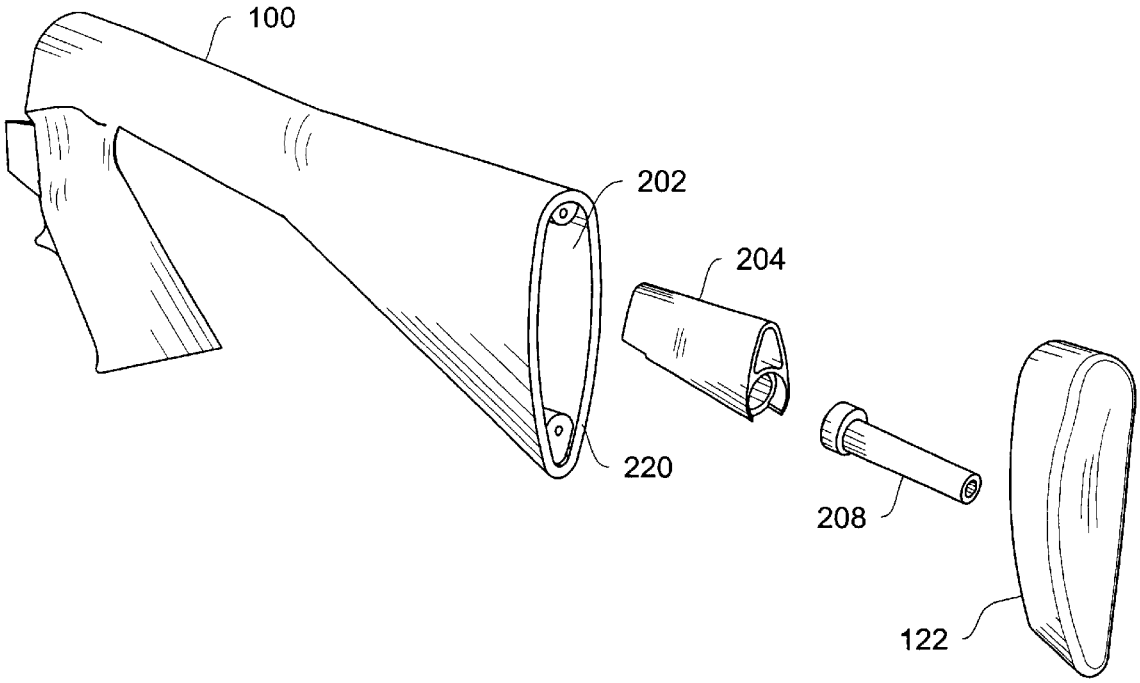
FIG. 3 is an exploded perspective view of various elements of the fall-length buttstock replacement kit of FIG. 1*a;*
Figure 4:
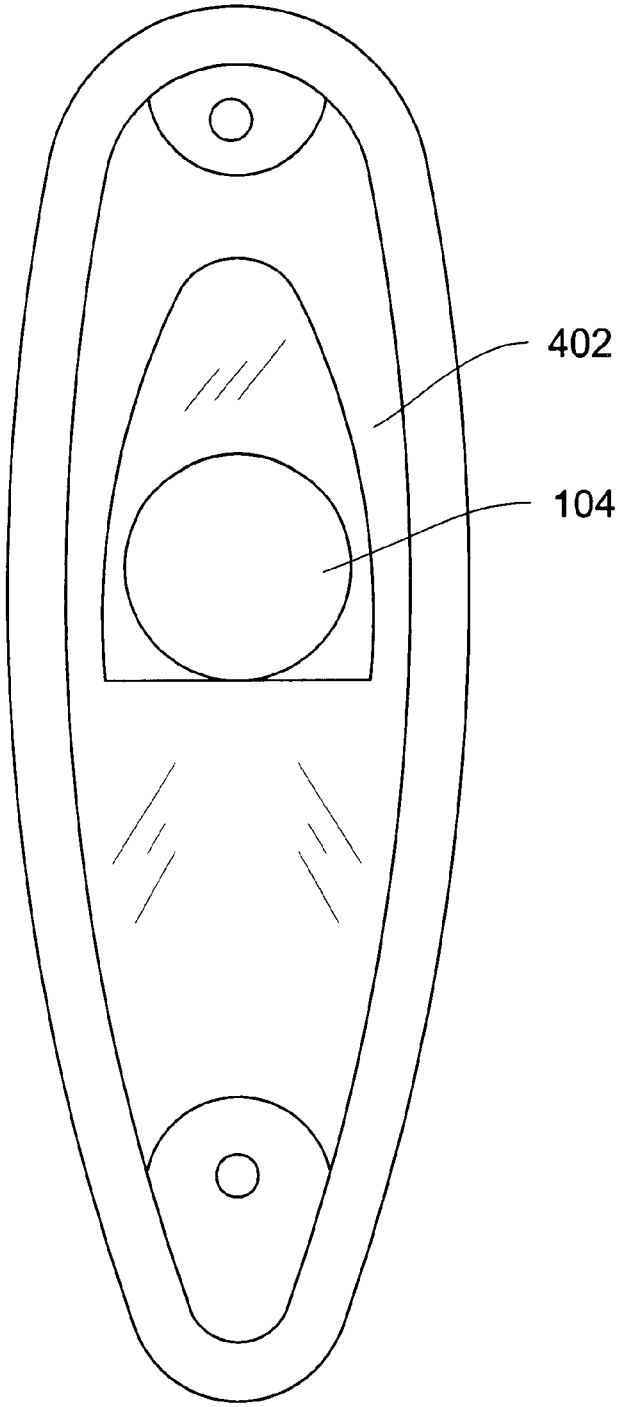
FIG. 4 is a rear view showing the interior of the buttstock of FIG. 1*a;*

As best seen in FIGS. 1*a*, 2 and 7, the kit suitably includes a predetermined number (e.g., 3) of respective rear adapters, e.g., 206, 208 and 210, for use singly, or in combination, to facilitate use of the original bolts 58 employed with various receivers to securely fastened stock 100 to receiver 50.

Various of the rear adapters, e.g., adapters 206 and 208, interact directly with platform 204. Each of those adapters suitably comprise a locating shoulder (e.g., 230, 234) and an extension (232, 236). The locating shoulder (e.g., 230, 234) suitably manifests an exterior peripheral configuration (e.g., exterior diameter) such that it can be received in locating bore 214, and preferably conforms to the interior peripheral configuration (e.g., interior diameter) of locating bore 214. The axial length of the locating shoulder (e.g., 230, 234) is preferably at least equal to the depth of locating bore 214. The extensions (e.g., 232, 236) suitably manifest an exterior peripheral configuration (e.g., exterior diameter) such that they can be received within platform passageway 212, preferably conforming to the interior peripheral configuration (e.g., interior diameter) of platform passageway 212. A longitudinal passageway (e.g., 702, 704) of a diameter chosen to pass the bolt 58 of the associated receiver 50, preferably co-axial with the extension extends through both the extension (e.g., 232, 236) and extension shoulder (e.g., 230, 234). For example, in the embodiment intended to accommodate for accommodating Mossberg, Remington, and Winchester pump shotguns, described above, longitudinal passageways 702 and 704 are suitably approximately 5/16, and ¼ inch in diameter, respectively.

The axial length of the extensions (e.g., 232, 236) of the various adapters (e.g., 206, 208) suitably differ to accommodate the variations in the lengths of original bolts 58 of the respective receiver configurations; the extension length is chosen such that, when the locating shoulder (e.g., 230, 234) is disposed within locating bore 214 of platform 204, and bolt 58 is journaled through the passageways in the rear adapter (e.g., 702, 704), platform passageway 212 and stock neck passageway 104, (and through any front adapter that might be employed), proper thread engagement for secure attachment to receiver 50 is provided and stock 100 is secured to the receiver. For example, in the embodiment for accommodating Mossberg, Remington, and Winchester pump shotguns, described above, adapters 206 and 208 are suitably approximately ¾ inch, and 2 ⅝ inches in length, respectively. In the preferred embodiment, the lengths of platform passageway 212 and stock neck passageway 104 are such that no adapter is required; when the shortest of bolts 58 (e.g., 58*b*) is journaled through platform passageway 212 and stock neck passageway 104, (and through any front adapter, or e.g., 900, that might be employed), proper thread engagement for secure attachment to receiver 50 is provided and stock 100 is secured to the receiver.

The disposition of the extension tube (e.g., 232, 236) relative to the center of the locating shoulder (e.g., 230,234) is suitably adjusted to accommodate variations in the relative disposition of the bore for receiving bolt 58 in the respective receiver configurations. For example, locating shoulder 230 and extension 232 (and passageway 702) of adapter 206 are substantially concentric, and are adapted to align bolt 58 with a threaded hole in receiver 50 disposed approximately at the center of stock neck passageway 104. In contradistinction, locating shoulder 234 and extension 236 (and passageway 704) of adapter 208 are eccentric, with the axis of extension 236 being offset by a predetermined distance (e.g., 1/16 inch to accommodate a Remington receiver) to the from the center of locating shoulder 234. Adapter 208 may thus be utilized to align bolt 58 with a threaded hole in receiver 50 disposed offset from the center of stock neck passageway 104. If necessary, the axis of the extension tube (e.g., 232, 236) may vary from that of the locating shoulder (e.g., 230, 234) to accommodate variations in angular orientation of bolt 58.

If desired, additional extensions, e.g., adapter 210, can be provided for use in combination with a shouldered adapter (e.g., 206, 208). The extension adapter is suitably substantially identical in cross-section to the extension portions (e.g., 232, 236) of the shouldered adapters.

As previously noted, each rear adapter, and/or combination of adapters is associated with one or more receiver configurations, and bolt lengths. A particular adapter can be utilized to accommodate more than one configuration by varying orientation. For example, by reversing the orientation of extension 232, adapter 206 can be employed to accommodate two different receiver configurations. With reference to FIG. 7*a*, in the preferred embodiment, as previously noted, stock forward portion 102 is suitably configured to conform to the rear surface 54 of a first receiver configuration, e.g., 98*a*, such as a Mossberg shotgun receiver having a rear surface 54*a*, and a centrally disposed standard bolt 58*a*.

Receiver 50*a* may be secured to stock 100 by: juxtaposing stock front portion 102 and receiver rear surface 54*a*; disposing rear adapter 206 with locating shoulder 230 received in the locating bore 214 and extension tube 232 directed toward the rear of stock 100. Bolt 58*a* may thus be journaled through passageways 702, 212, and 104, into alignment with a corresponding threaded hole 708 in rear surface 54*b* of receiver 50*b* in approximately the center of passageway 104. When bolt 58*a* is threaded into hole 706, and its head ultimately seats against the rearward surface of adapter 206 i.e. the flat end surface of extension 232, proper engagement to secure stock 100 to receiver 50*a* is achieved. Further, referring briefly to FIG. 5, when stock front portion 102 and receiver rear surface 54*a* are secured in juxtaposition, the desired drop 502, shoulder pull 504, and finger pull 506 parameters are achieved.

If the orientation of adapter 206 relative to platform 204 is reversed, such that extension tube 232 is received in platform passageway 212, the combination of platform 204 and adapter 206 corresponds to a different distance into the interior of stock 100. As previously noted, the length of platform 204 (and passageway 104) is chosen such that the rearward end of platform 204 is approximately co-incident with, or forward of, the shortest excursion of bolt 58 into the interior of stock 100. In the present example, the shortest distance corresponds to the standard bolt 58*a* of the Winchester style receiver 50*b*. As also previously noted, the thickness of shoulder 230 preferably approximates the depth of locating bore 214. Bolt 58*b* may thus be journaled through passageways 702, 212, and 104 into alignment with a corresponding threaded hole 706 in rear surface 54*b* of receiver 50*b* in approximately the center of passageway 104. When bolt 58*b* is threaded into hole 706, and its head ultimately seats against the rearward surface of adapter 206 i.e. the flat end surface of shoulder 230, proper engagement to secure stock 100 to receiver 50*b* is achieved. For example, referring to FIG. 7*b*, stock 100 can be secured to a second receiver configuration, e.g., 50*b*, such as a Winchester shotgun receiver having a rear surface 54*b*, and a centrally disposed standard bolt 58*b* by: interposing adapter 900 between stock front portion 102 and receiver rear surface 54*b*; disposing rear adapter 206 with extension tube 232 received in platform passageway 212, and locating shoulder 230 received in the locating bore 214. Bolt 58*b* may thus be journaled through passageways 702, 212, and 104, and a passageway (904) in front adapter 900 into alignment with a corresponding threaded hole 708 in rear surface 54*b* of receiver 50*b* in approximately the center of passageway 104. When bolt 58*b* is threaded into hole 708, and its head ultimately seats against the rearward surface of adapter 206, i.e., the flat end surface of excursion 232, proper engagement is achieved to secure stock 100 to receiver 50*b* with the desired drop, shoulder pull, and finger pull.

Preferably, however, the lengths of platform passageway 212 and stock neck passageway 104 are such that no adapter is required for the Winchester configuration; when bolt 58*b* is journaled through platform passageway 212, stock neck passageway 104, and through front adapter 900, proper thread engagement for secure attachment to receiver 50*b* is provided and stock 100 is secured to receiver 50*b*.

As previously noted, additional extensions, e.g., adapter 210, can employed in combination with a shouldered adapter (e.g., 206, 208) to accommodate further bolt excursions. For example, certain models, or vintages of receivers may have substantially identical rear surfaces 54, but employed different length bolts 58. The different bolt lengths are readily accommodated utilizing, e.g., additional extension 210 of a predetermined length, e.g., 2 inches.

Likewise, bolt 58 may be disposed off center from passageways 104 and 212, because of, for example, drop requirements. Offset bolts are accommodated by employing passageways 104 and 112 of sufficient diameter to accommodate the offset; and use of adapters with extensions (and passageways) appropriately offset from the center of the locating shoulder.

For example, referring to FIG. 7*c*, stock 100 can be secured to a second receiver configuration, e.g., Winchester shotgun receiver 50*c*, having a rear surface 54*c*, and a standard original bolt 58*c* disposed along an axis downwardly offset from the center of passageway 104 by: interposing adapter 800 between stock front portion 102 and receiver rear surface 54*c*; disposing rear adapter 208 with locating shoulder 234 received in the locating bore 214 and extension tube 236 directed toward the rear of stock 100. As previously noted, the axis of extension 236 (and thus passageway 704) is offset from the center of locating shoulder 234 (and thus from the center of passageways 212 and 104). Accordingly, bolt 58*c*, when journaled through passageways 704, (and accommodated by passageways 212, and 104, and 804 (in front adapter 800) is placed into alignment with the corresponding threaded hole 710. If a bolt 58*c* of a first length is employed, it would, when threaded into hole 708, ultimately seat against the rearward surface of adapter 206, i.e., the flat end surface of excursion 236. However, if a longer screw 58*c* was employed, it would be journaled through a passageway 712 in extension adapter 210, prior to passing through adapter 208. The, proper engagement is thus achieved to secure stock 100 to receiver 50*c* with the desired drop, shoulder pull, and finger pull.

Figure 10:
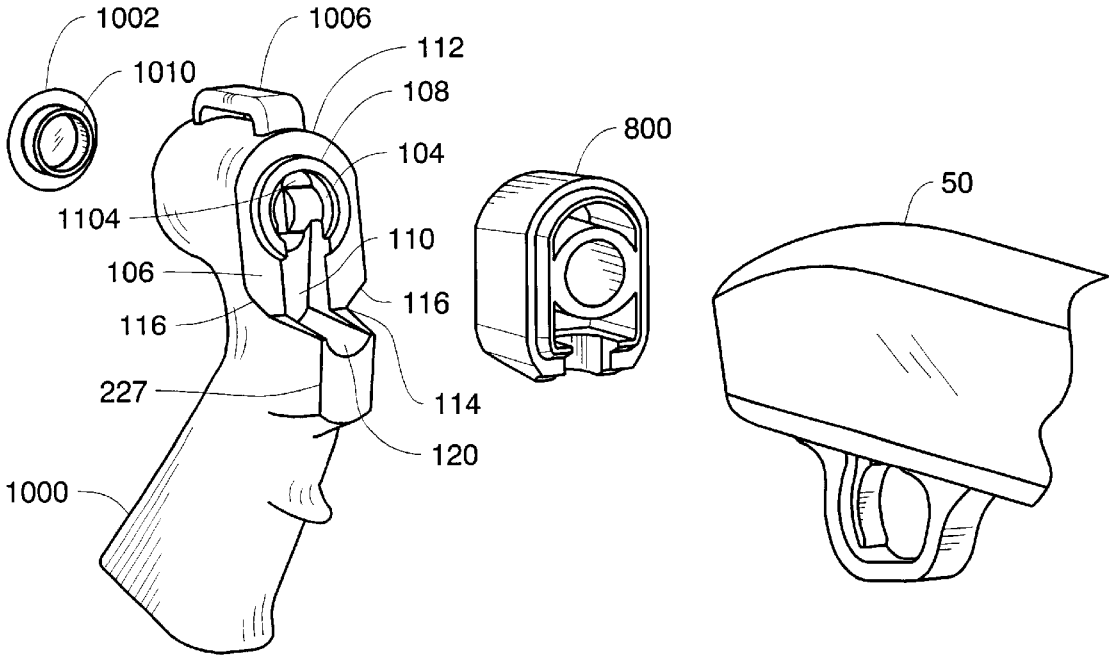
FIG. 10 is an exploded perspective view of various elements of the rear pistol grip stock kit of FIG. 1*b* together with a portion of a receiver.

As previously noted, forward portion 102 of rear stocks 100 and 1000, is suitably configured to conform to the rear surface 54 of a first receiver configuration, e.g., Mossberg configuration 50*a*. Referring to FIGS. 1*a*, 1*b*, and 10, forward portion 102 thus preferably includes a generally flat surface 106, a generally cylindrical protruding shoulder 108 circumscribing passageway 104. Surface 106 and shoulder 108 are suitably notched by a straight sided recess 110. Recess 110 suitably communicates with passageway 104. The periphery of surface 106 is suitably generally rectangular with a rounded top 112 (suitably concentric with shoulder 108 and passageway 104), straight sides, and a flat bottom 114 with chamfered bottom comers 116. As previously noted, passageway 104 is sufficiently large to accommodate bolts 58 that are offset from center. Forward extending portion 227 of pistol grip 224 suitably includes a notch 120 communicating with recess 110, to accommodate protrusions on the underside of various receivers.

As previously noted, front adapters 900 and 800 adapt rear stocks 100 and 1000 to second and third receiver configurations 50*b* and 50*c*, respectively. Adapters 800 and 900 each include rearward portions (801, 901) conforming to the configuration of stock forward portion 102 and forward portions (803,903) conforming to the configuration of the receiver associated with the particular adapter. Thus, in the preferred embodiment, the rearward portion of adapters 800 and 900 in effect replicate the contours of rear surface 54*a* of first configuration 50*a*.

Figure 8A:
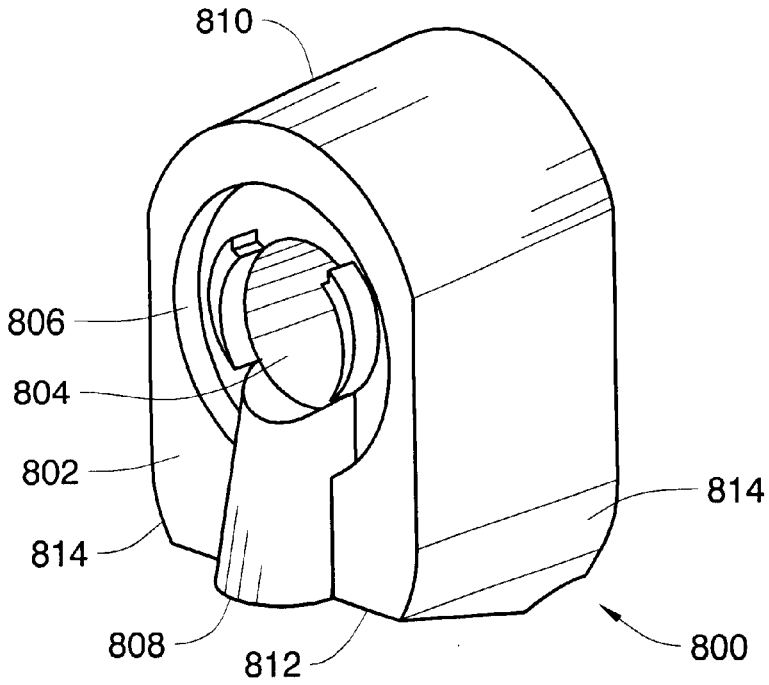
FIGS. 8*a* and 8*b* (collectively referred to as FIG. 8) are rear and front perspective views, respectively, of a first adapter for the stocks of FIGS. 1*a* and 1*b;*

Referring to FIG. 8*a*, the rearward portion of adapter 800 includes: a generally flat surface 802; a passageway 804 disposed to communicate, when in situ, with passageway 104 stock forward portion 102; a generally annular recess 806, formed in surface 802, disposed and configured to receive projecting shoulder 108 of stock forward portion 102; and a outward going projection 808 disposed and configured to be received in slot 110 of stock forward portion 102. The periphery of surface 802, conforms to that of surface 106 of stock forward portion 102, i.e. is generally rectangular with a rounded top 810, a flat bottom 812 with chamfered bottom comers 814 (defining a predetermined height, e.g., 1 ¾ in.) and straight sides a predetermined width apart, e.g., 1.41 inches. Annular recess 806 and passageway 804 are suitably generally concentric with the rounded top, although passageway 804 may be slightly downwardly offset.

Figure 8B:
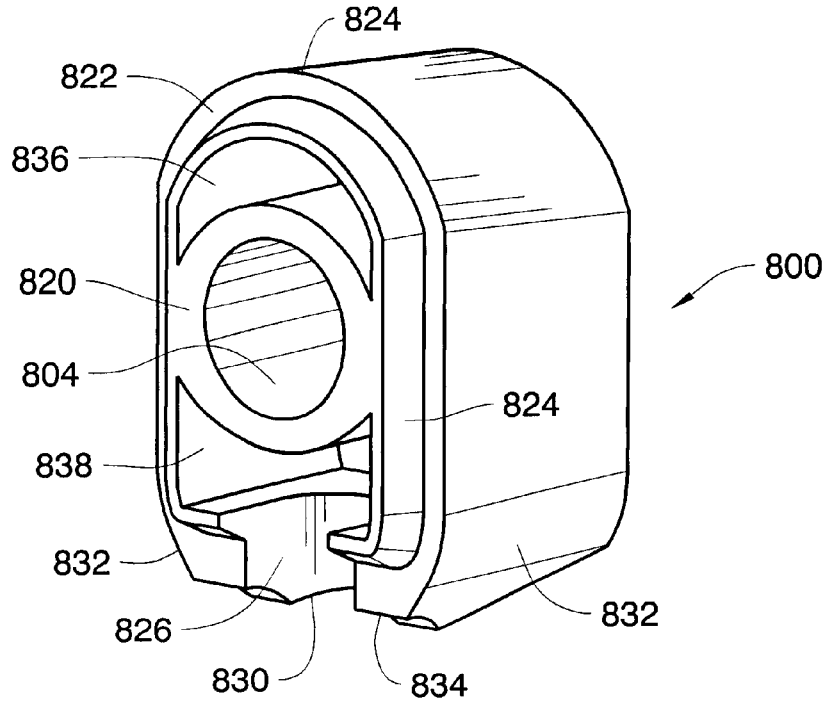

Referring to FIG. 8*b*, the forward portion of adapter 800, configured to conform to the contours of receiver 50*c* includes: a generally flat surface 820, with a peripheral recess having a rear wall 822 and side walls 824; the opening of passageway 804 disposed to communicate, when in situ, with threaded hole 710 in receiver 50*c*; and a slot 826 formed in surface 820 through side walls 824, and rear wall 822, and extending to the bottom 830 of adapter 800. The periphery of surface 820, of substantially the same width e.g., 1.41 inches, but is of greater height, e.g., approximately 2.21 inches, than rear surface 802, and is of generally generally the same peripheral shape, i.e. is generally rectangular with a rounded top 824, flat bottom 830 with chamfered bottom comers 832. Accordingly, adapter 800 gradually increases in height from back to front.

Rear wall 822 and side walls 824 of the peripheral recess are configured to conform to the interior wall of the peripheral lip of configuration 50*c* such that surface 820 is received within the peripheral lip of configuration 50*c* and the forward edge of the lip lodges against surface 822. Slot 826 is disposed and configured to receive the projecting shoulder of configuration 50*c*. In addition, the bottom front edge of surface 822 is radiused, generally indicated at 834. Adapter 800 is suitably formed of molded polymer preferably 33 percent glass filled nylon, and, if desired, may include respective lightening cavities 836 and 838. Cavity 838 cooperates with slot 826 to admit the projection of rear surface 54*c* of configuration 50*c*.

Figure 9A:
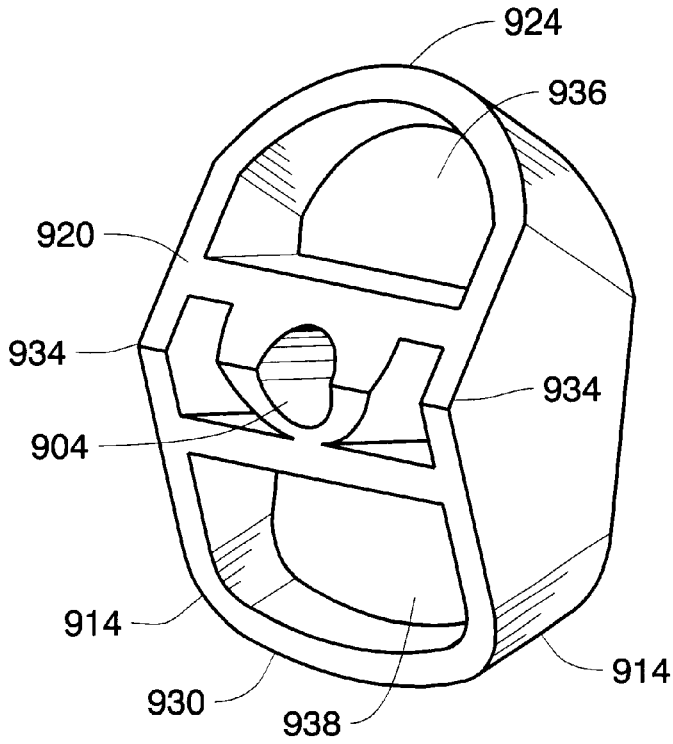
FIGS. 9*a* and 9*b* (collectively referred to as FIG. 9) are front and rear perspective views, respectively, of a second adapter for the stocks of FIGS. 1*a* and 1*b;*

Adapter 900 includes a front portion configured to conform to the contours of receiver 50*b*. Referring to FIG. 9*a*, the front portion of adapter 900 includes a front surface 920, and a passageway 904. The periphery of surface 920 includes a rounded top 924, a generally flat bottom 930, with rounded corners 932, and straight sides. When viewed from the side, front surface 920 advances from top 924 and bottom 930 to an apex 934 at the center (V's out), i.e. surface 902 is in effect defined by two planes that intersect along a line at apex 934. Passageway 904 is disposed at in the center of the line at apex 910, and communicates with the threaded hole in receiver 50*b* for receiving bolt 58*c*. Adapter 900 is suitably formed of molded polymer, preferably 33 percent glass filled nylon, and, if desired, may include respective lightening cavities 936, 938, 940 and 942.

Figure 9B:
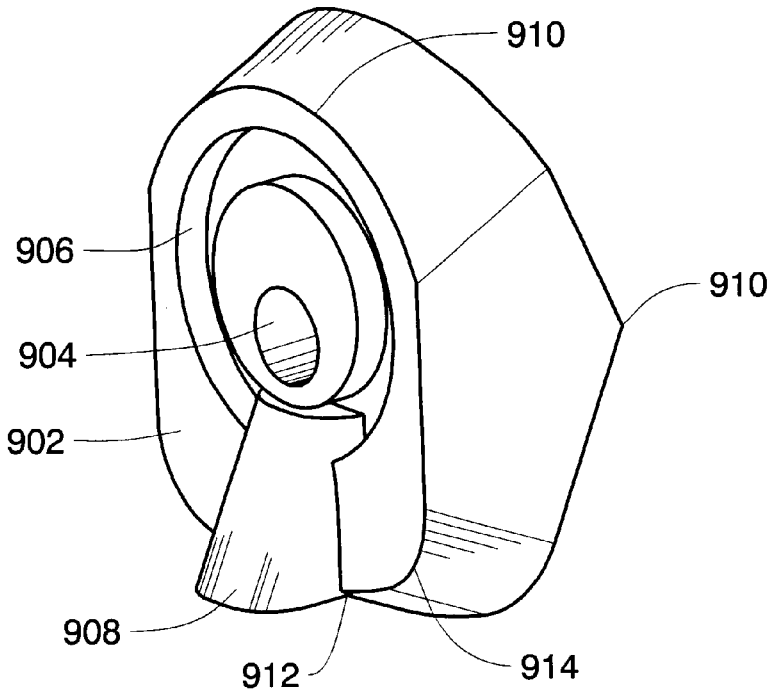

Referring to FIG. 9*b*, the rearward portion 901 of adapter 900 is substantially similar to the rearward portion 801 of adapter 800, including: a generally flat surface 902; passageway 904 disposed to communicate, when in situ, with passageway 104 stock forward portion 102; a generally annular recess 906, formed in surface 902, disposed and configured to receive projecting shoulder 108 of stock forward portion 102; and a outward going projection 908 disposed and configured to be received in slot 110 of stock forward portion 102. The periphery of surface 902, conforms to that of surface 106 of stock forward portion 102, i.e. is generally rectangular with a rounded top 910, straight sides, and a flat bottom 912 with chamfered bottom corners 914. Annular recess 806 is suitably generally concentric with rounded top 910. Passageway 804 is downwardly offset relative to the center of recess 806, and thus, when in situ, the center of passageway 104. The periphery of surface 920, is of substantially the same width as, but is of greater height than rear surface 902, e.g., approximately 2.25 inches. Accordingly, adapter 900 gradually increases in height from back to front.

Figure 11:
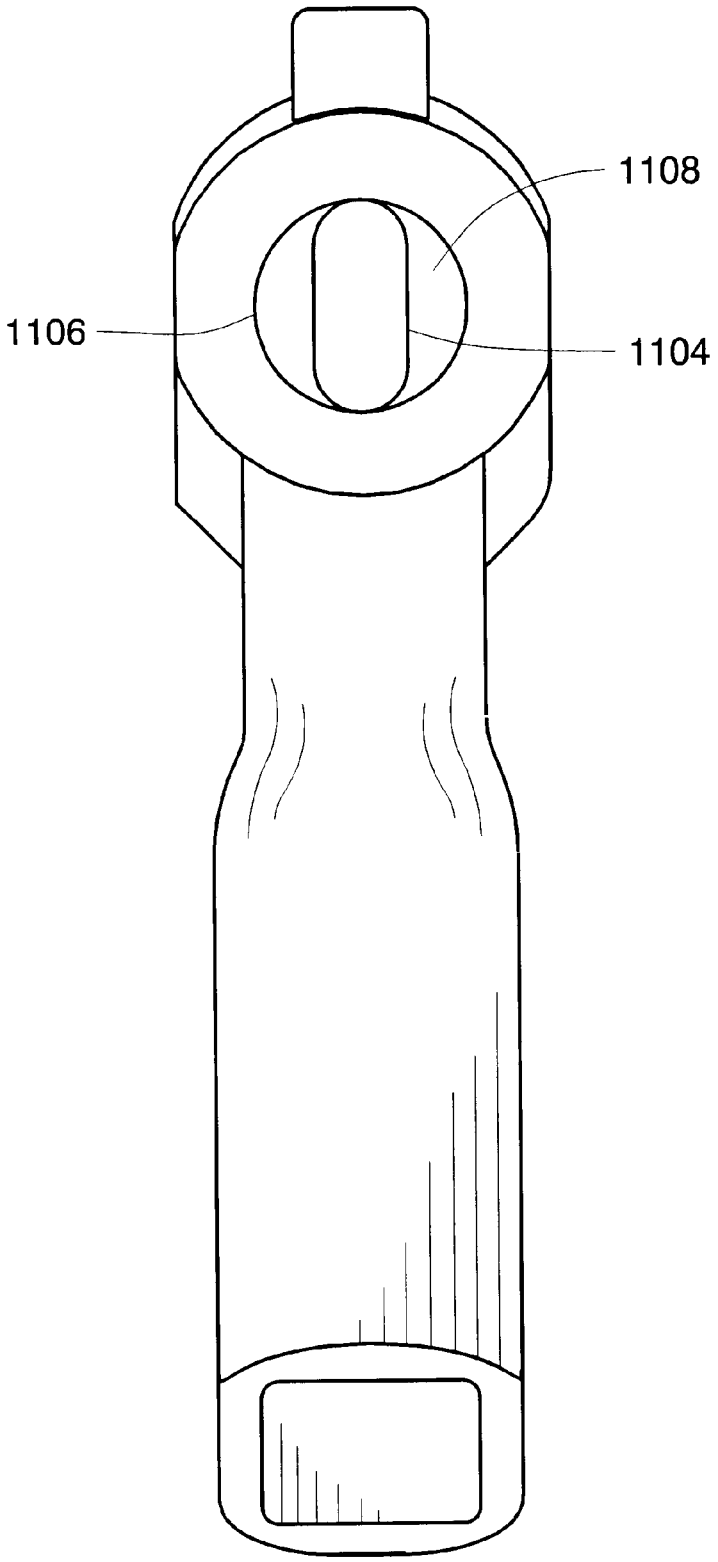
FIG. 11 is a rear view of the rear pistol grip stock of FIG. 1*b;*

With a rear pistol grip stock, the drop and shoulder pull parameters are not relevant, but it is desirable to meet the finger pull parameter. Referring to FIGS. 1*b*, 10 and 11, rear pistol grip 1000 is of substantially the same configuration as pistol grip portion 224 of stock 100, and includes a forward portion 102 substantially identical to that of stock 100. However, passageway 104 includes an elongated slot shaped (rectangular with rounded top and bottom) passageway 1104 extending rearwardly from front flat surface 106 and communicating with a larger diameter rear passageway 1106. The juncture of passageways 1104 and 1106, forms a shoulder 1108. Elongated passageway 1104 is employed in combination with replacement bolts 132, 134, and 136 to accommodate the varying excursions and dispositions of the original bolts 58. Replacement bolts 132, 134, and 136 correspond to original bolts 58*a*, 58*b*, and 58*c*, but are of a length such that the bolts seat against shoulder 1108 when securely engaged in the threaded hole of the receiver, e.g., 2.75, 3.25 and 3.5 inches shaft length for the Mossberg, Winchester, and Remington receivers, respectively.

End cap 1002 is employed to close off rear passageway 1106. End cap 1002 suitably includes a lip 1010 having an outer diameter closely corresponding to the inner diameter of rear passageway 1106, such that a friction fit is effected to secure end cap 1002 in covering relationship with rear passageway 1106.

Figure 12:
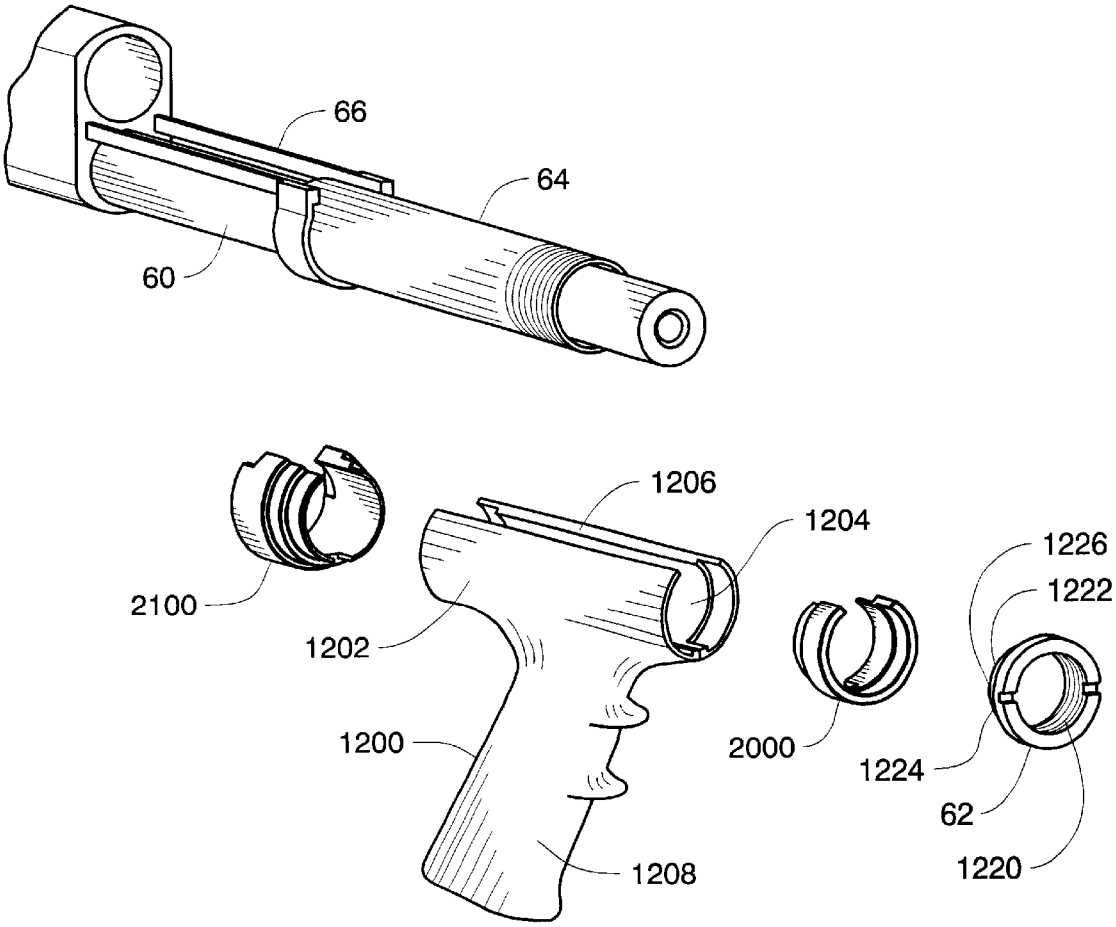
FIG. 12 is an exploded perspective view of various elements of the pistol grip fore-stock kit of FIG. 1*d*, together with a portion of a receiver.

With reference now to FIG. 12, receiver 50, as previously noted, particularly with respect to shotguns, typically also includes a magazine 60, and, in many instances, a cocking mechanism with forward extending components such as: a slide 64; action bars 66, coupling slide 64 to the internal receiver mechanism; and a removable end ring 62 (typically threaded onto the end of slide 64. In general, a stock fore-stock is fastened to and over the magazine and/or cocking mechanism components. For example, the stock fore-stock of a pump shotgun is typically secured over slide 64, at least partially surrounding slide 64 and held in place by action bars 66 at the rear and end ring 62 in the front. Most standard fore-stocks extend a rearwardly beyond magazine 60, and include a recess to receive and slide over a portion of receiver 50 adjacent to magazine 60. As previously noted, diameters and different lengths of the slide, and configurations of rails 66 and end ring 62 tend to vary between different types and models of firearms. Accordingly, a kit in accordance with the present invention may include, as illustrated in FIGS. 1*c* and 1*d*, one or more fore-stocks, such as standard fore-stock 150 and/or pistol grip fore-stock 180; together with a predetermined number e.g., 4, of respective front adapters (e.g., 1500, 1600, 1800 and 2000), and a predetermined number e.g., 3, rear adapters (e.g., 1700, 1900 and 2100). Various combinations of rear adapters and front adapters, correspond to respective for receiver configurations, and adapt fore-stock 150 (or 180) to fit those receiver configurations. Each of the rear adapters (e.g., 1700, 1900 and 2100) include a rear portion corresponding to the configuration of the associated receiver, and a front portion configured to mate with the rear of fore-stocks 150 and 180. Similarly, each of the front adapters (e.g., 1500, 1600, 1800 and 2000) include a rear portion configured to mate with the rear of fore-stocks 150 and 180, and a front portion corresponding to the configuration of the associated receiver, e.g., nut 62.

Figure 13:
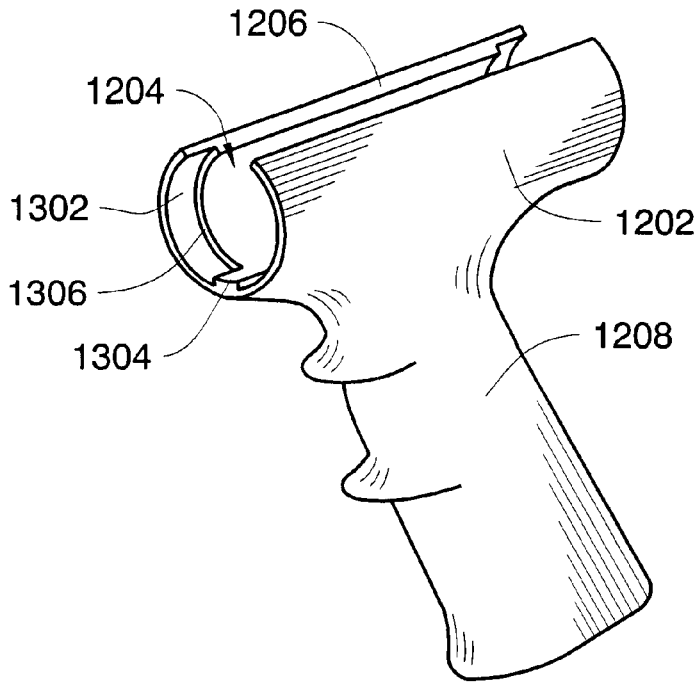
FIGS. 13 and 14 are front perspective and rear perspective views, respectively, of the pistol grip fore-stock of FIG. 1*d;*
Figure 14:
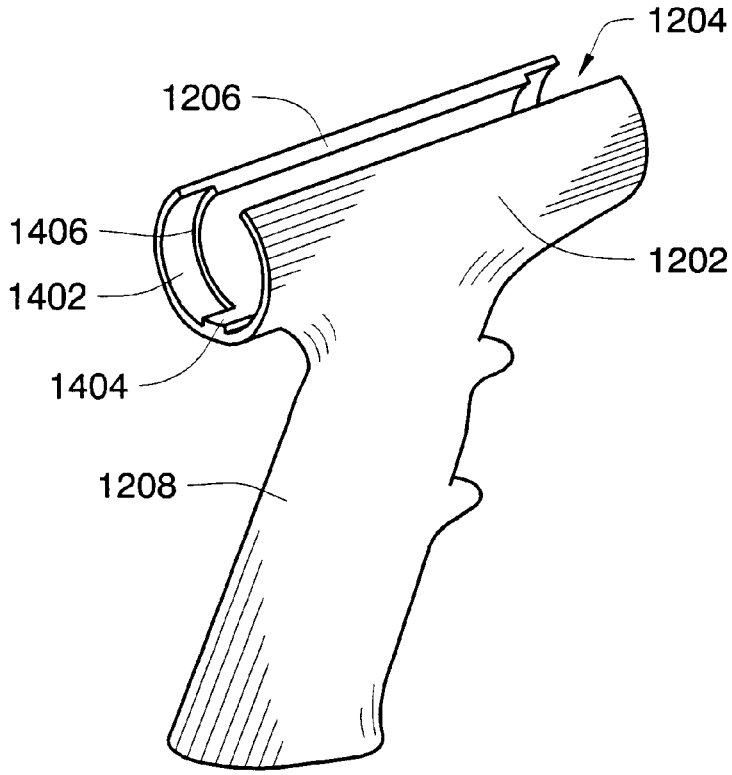

More specifically, referring to FIGS. 12–14, pistol grip fore-stock 1200 suitably includes a generally tubular body 1202, and grip portion. 1208. Body 1202 is of a predetermined length, e.g., 5 ½ inches, suitably short enough to accommodate the shortest slide length of the receiver configurations with which the kit is intended to be used, and of predetermined exterior diameter, e.g., 1 ⅜ inches. Body 1202 includes a hollow interior 1204 and longitudinal open slot 1206 along the top thereof. The cross-section of hollow interior 1204 suitably large enough to receive the largest diameter slide 64 of the receivers which the kit is intended to accommodate, for example, of a predetermined diameter, e.g., 1 inch. Slot 1206 is disposed and configured, e.g., is sufficiently wide and with angled sides to allow clearance for the firearm barrel at its largest diameter when the slide is fully retracted. Body 1202 is suitably of predetermined thickness, e.g., 3/16 inch. An increased interior diameter (ID) portion (recess) 1302 having a predetermined differential in diameter, e.g., 1/16 inch, extends inwardly a predetermined distance, e.g., 3/8 inch from the front edge of interior 1204. Recess 1302 includes a key 1304, and terminates in a rear wall 1306. Key 1304 is suitably rectangular, of a height commensurate with the depth of recess 1302, extends from the front edge of interior 1204 to wall 1306, and disposed opposite (180 degrees from) the center of longitudinal slot 1206. A similar keyed recess 1402 is provided at the rear of interior 1204. Recess 1402 suitably manifests a predetermined difference in diameter, e.g., 1/16 inch, and extends inwardly a predetermined distance, e.g., 3/8 inch from the rear edge of interior 1204. Recess 1402 includes a key 1404, and terminates in a rear wall 1406. Key 1404 is suitably rectangular, of a height commensurate with the depth of recess 1402, extends from the front edge of interior 1204 to wall 1406 and disposed opposite (180 degrees from) the center of longitudinal slot 1206, i.e. aligned with key 1304.

Referring now to FIGS. 15, 16, 18, and 20, front adapters 1500, 1600, 1800 and 2000 all include generally tubular hollow bodies 1502, 1602, 1802, and 2002 with a longitudinal open slot 1503, 1603, 1803, and 2003, respectively, along the top thereof. In general, the interior diameter of the adapter substantially conforms to the diameter of slide 64, and the length of the adapter body is in accordance with the length of the slide 64 of the associated receiver 50 (and the configuration (e.g., length) of fore stocks 1200, or 2200 and cooperating rear adapter e.g., 1700, 1900 or 2100). For example, a front adapter configured to accommodate an old-style (long) Mossberg pump shotgun receivers (e.g., adapters 1500 is suitably approximately 1.85 inches in length, and a front adapter configured to accommodate new style (short) Mossberg pump shotgun receivers (e.g., adapter 1600, is suitably approximately 0.84 inch in length, and front adapters configured to accommodate Winchester, and Remington pump shotgun receivers (e.g., adapters 1800 and 2000) are suitably approximately 0.88 inch in length. The outer diameter of the adapter generally conforms to the outside diameter of the pistol grip fore end 180 and the internal diameters on the front and rear of standard fore-stock 150.

As noted above, each of the front adapters (e.g., 1500, 1600, 1800 and 2000) includes a rear portion configured to mate with the front of fore-stocks 150 and 180, e.g., to be received in keyed recess 1302. Referring to FIGS. 15*a*, 16*a*, 18*a*, and 20*a*, each of the front adapters 1500, 1600, 1800 and 2000 include a rear portion comprising reduced exterior diameter portion (exterior recess) 1504, 1604, 1804, and 2004, respectively, configured to be closely received in recess 1302. The exterior diameter of portions 1504, 1604, 1804, and 2004 correspond to the interior diameter of fore-stock 150, 180 in recess 1302. Each reduced exterior diameter portion 1504, 1604, 1804, and 2004 includes slot 1505, 1605, 1805, and 2005 configured to receive key 1304 and disposed opposite (180 degrees from) the center of longitudinal slot 1206 such that, when key 1304 is received in slot 1505, 1605, 1805, or 2005, the open slot (1505, 1605, 1805, 2005) is aligned with slot 1206 of fore-stock 1200. Reduced exterior diameter portions 1504, 1604, 1804, and 2004 terminate in rear walls 1506, 1606, 1806, and 2006, respectively.

As noted above, each of the front adapters 1500, 1600, 1800 and 2000 also includes a front portion corresponding to the configuration of the original standard end nut 62 of an associated receiver. Referring briefly to FIG. 12, the original end nut 62 of most standard receivers is typically cylindrical, of a predetermined diameter, with interior threads 1220, and rear shoulder 1222 configured to butt against the fore-stock and retain the fore-stock on slide 64. In some cases nut 62 includes a reduced exterior diameter portion 1224 (typically received in the original fore-stock) in the vicinity of the threads that cooperate with slide 64 terminating in a rear shoulder 1226. In general, the front adapters each include front portion configured to cooperate with e.g., receive a portion of and/or butt against, the original standard end nut 62 of the associated receiver 50. In the (uncommon) event that the original standard end nut 62 includes any features, e.g., protrusions, flats, etc. to facilitate coupling to slide 64 or engagement with the original fore-stock, corresponding accommodation features would be included in the front portion of the adapter.

Figure 15A:
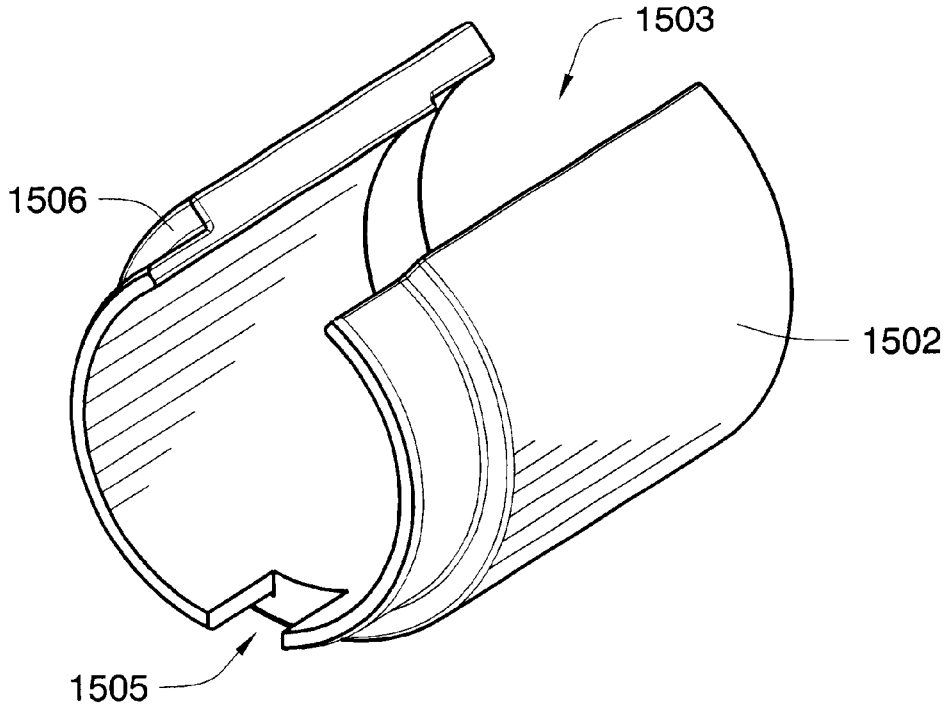
FIGS. 15*a* and 15*b* (collectively referred to as FIG. 15) are rear and front perspective views, respectively, of a first front adapter for the fore-stocks of FIGS. 1*c* and 1*d;*
Figure 15B:
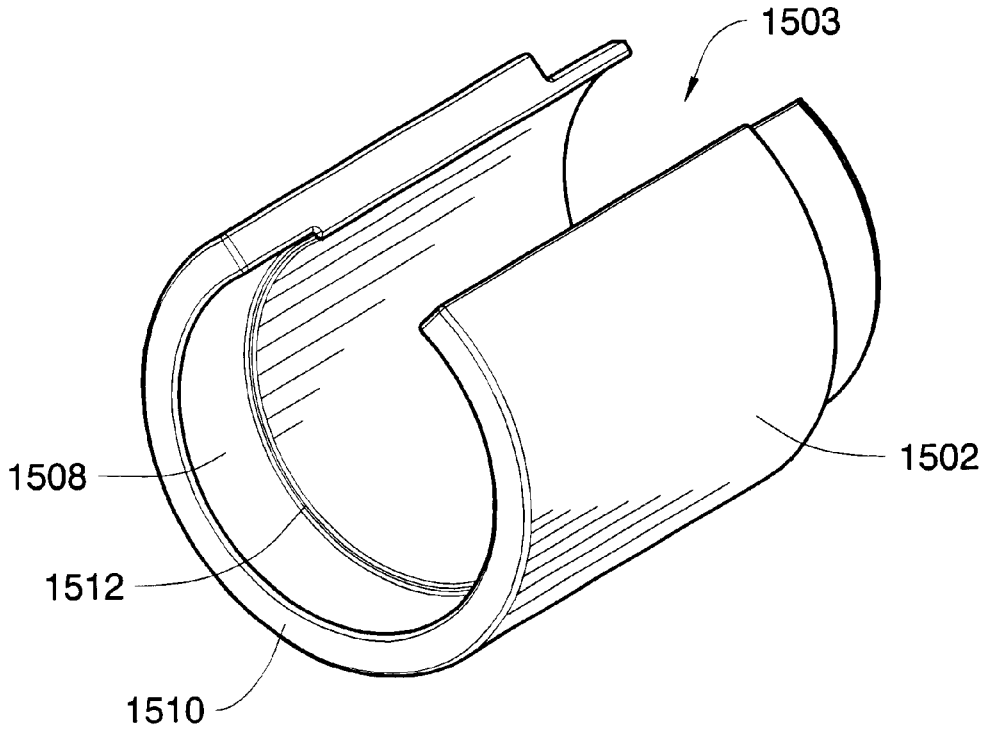
Figure 16A:
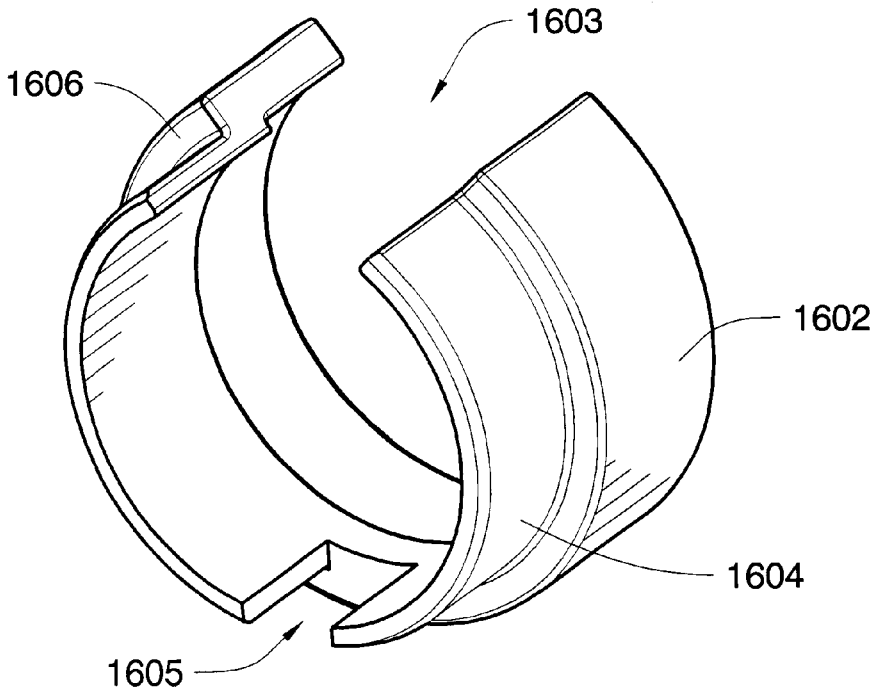
FIGS. 16*a* and 16*b* (collectively referred to as FIG. 16) are front and rear perspective views, respectively, of a second front adapter for the fore-stocks of FIGS. 1*c* and 1*d;*
Figure 16B:
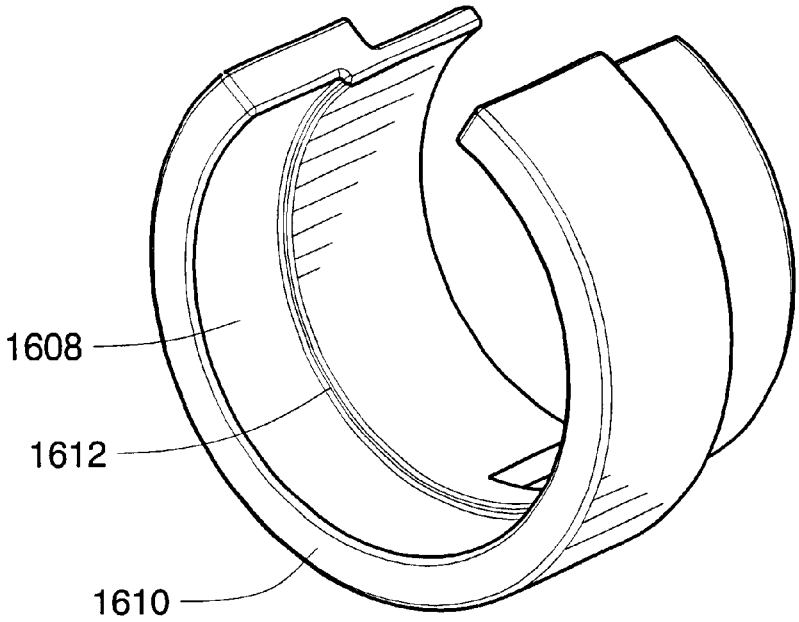
Figure 20A:
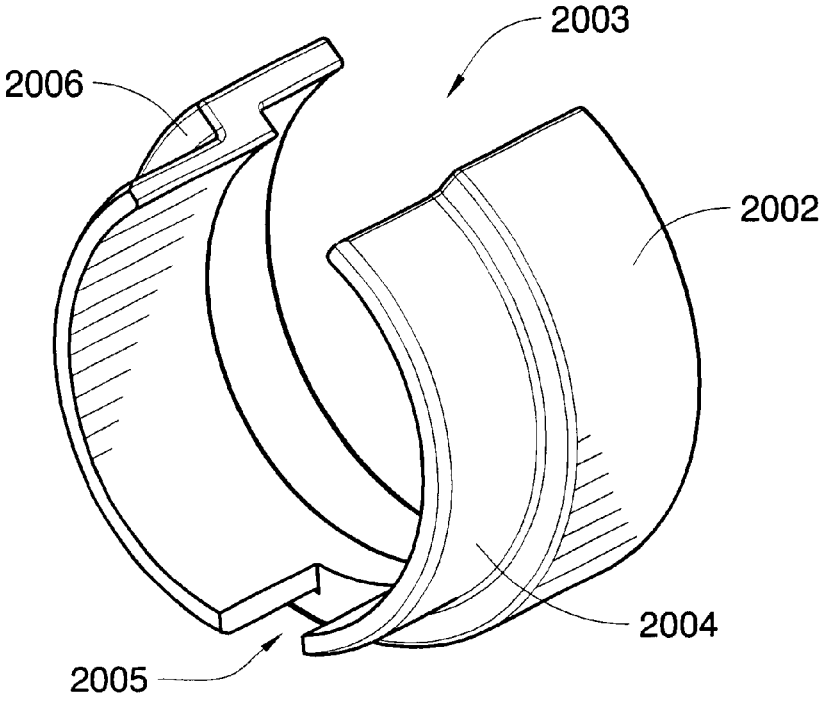
FIGS. 20*a* and 20*b* (collectively referred to as FIG. 20) are rear and front perspective views, respectively, of a fourth front adapter for the fore-stocks of FIGS. 1*c* and 1*d;*
Figure 20B:
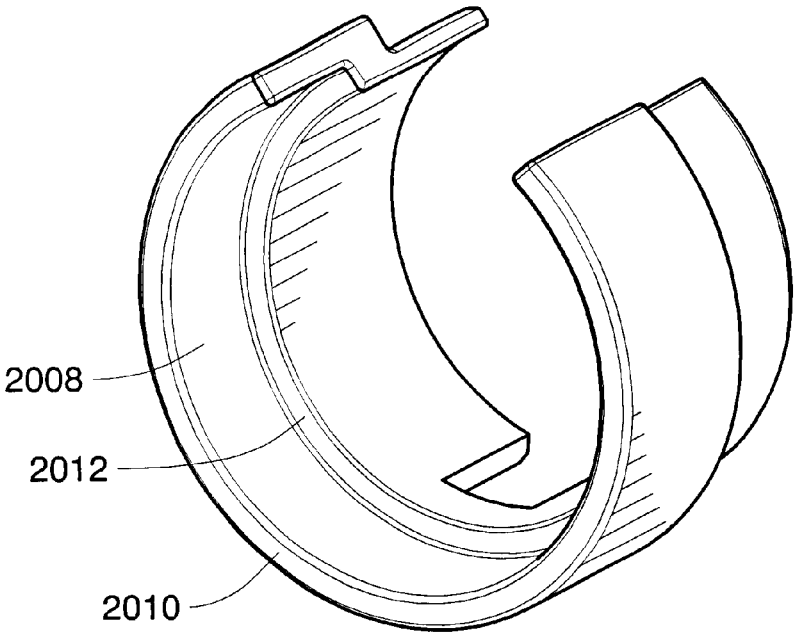

For example, the original end nuts 62 employed with Mossberg and Remington pump shotguns typically include a reduced exterior diameter portion in the vicinity of the threads that cooperate with slide 64. Referring to FIGS. 15*b*, 16*a*, and 20*b*, front adapters 1500, 1600, and 2000, associated with, e.g., old-style (long) and new style (short) Mossberg, and Remington pump shotguns, respectively, include front portions comprising increased interior diameter (ID) portions (interior recess) 1508, 1608, and 2008, respectively, configured to receive the reduced exterior diameter portion of the corresponding nut 62, extending from the front surface 1510, 1610, and 2010, respectively of the adapters to a terminating interior shoulder, 1512, 1612, and 2012, respectively. The axial extent (distance from the front surface to terminating shoulder) of the increased ID portions suitably corresponds to that of reduced exterior dimension portion 1224 of the associated nut 62, preferably such that, when assembled with nut 62 engaged with slide 64, shoulders 1222 and 1226 of nut 62 abut securely against the terminating interior shoulder, (1512, 1612, or 2012) and front surface (1510, 1610, 2010) of the adapter.

Figure 18A:
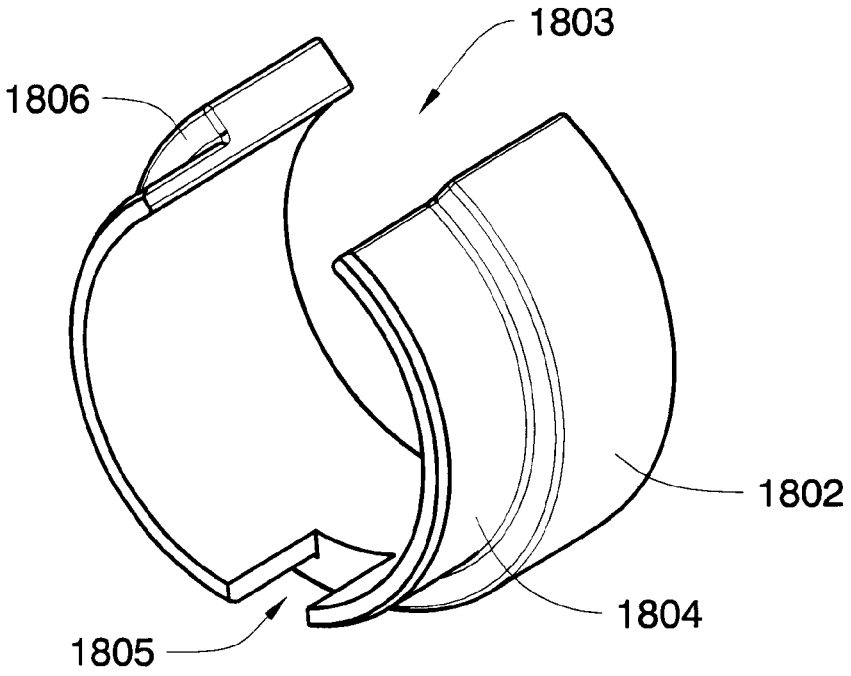
FIGS. 18*a* and 18*b* (collectively referred to as FIG. 18) are rear and front perspective views, respectively, of a third front adapter for the fore-stocks of FIGS. 1*c* and 1*d;*
Figure 18B:
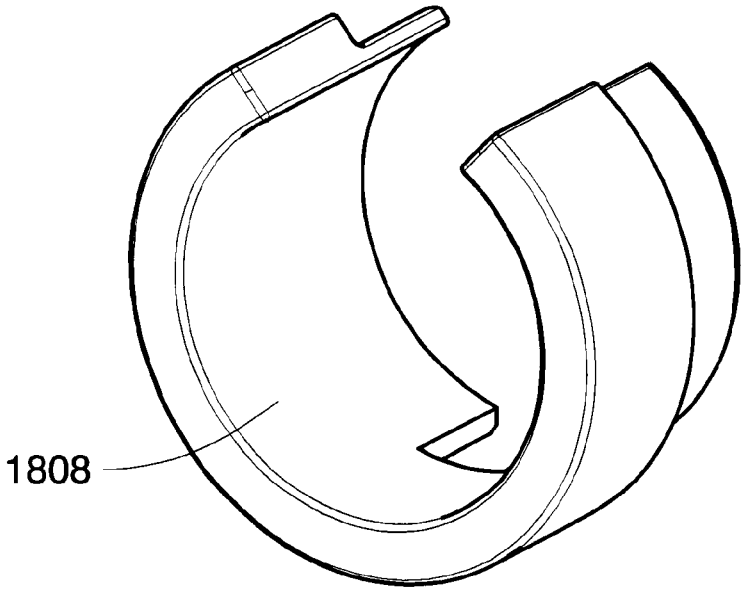

Conversely, the original end nut 62 employed with Winchester pump shotguns typically do not include a reduced exterior diameter portion in the vicinity of the threads that cooperate with slide 64; rear shoulder 1222 of end nut 62 abuts directly against the front surface of the standard fore-stock. Referring to FIG. 18*b*, adapter 1800 provides a front surface 1810 disposed such that when assembled with nut 62 engaged with slide 64, shoulders 1222 of nut 62 abuts securely against the front surface 1810.

Referring now to FIGS. 17, 19, and 21, rear adapters 1700, 1900 and 2100 all include generally tubular hollow bodies 1702, 1902, and 2102 with a longitudinal open slot 1703, 1903, and 2103, respectively, along the top thereof. Bodies 1702, 1902, and 2102 each suitably include front (1706, 1906, and 2106), intermediate (transition) (1706, 1906, and 2106) and rear (1708, 1908, and 2108) portions. As previously noted, the front portion (1706, 1906, 2106) is configured to mate with the rear of fore-stocks 150 and 180 e.g., to be received in keyed recess 1402, and the configuration of the rear portion (1708, 1908, 2108) corresponds to the configuration of the associated receiver. The intermediate portion (1706, 1906, and 2106) provides an appropriate transition between the front and rear portions.

In general, the interior diameter of the adapter substantially conforms to the diameter of slide 64 and the length of the adapter body (from a forward shoulder (1709, 1909, and 2109) to a rear shoulder (1718, 1918, and 2118)) is in accordance with the length of the slide 64 of the associated receiver 50 (and the configuration (e.g., length) of fore stocks 1200, or 2200 and cooperating front adapter e.g., 1500, 1600, 1800 and 2000). For example, rear adapters configured to accommodate an Mossberg (e.g., adapter 1700) Winchester (e.g., adapter 1900), and Remington (e.g., adapter 2100) pump shotgun receivers are suitably approximately 1.47, 1.500, and 1.51 inches in length.

Figure 17A:
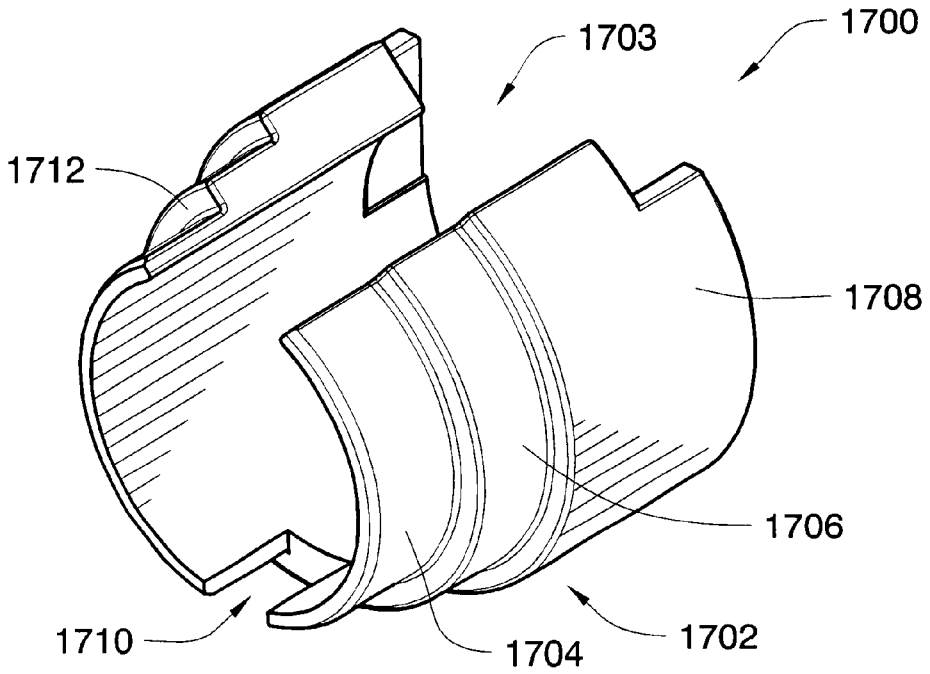
FIGS. 17*a* and 17*b* (collectively referred to as FIG. 17) are front and rear perspective views, respectively, of a first rear adapter for the fore-stocks of FIGS. 1*c* and 1*d*
Figure 17B:
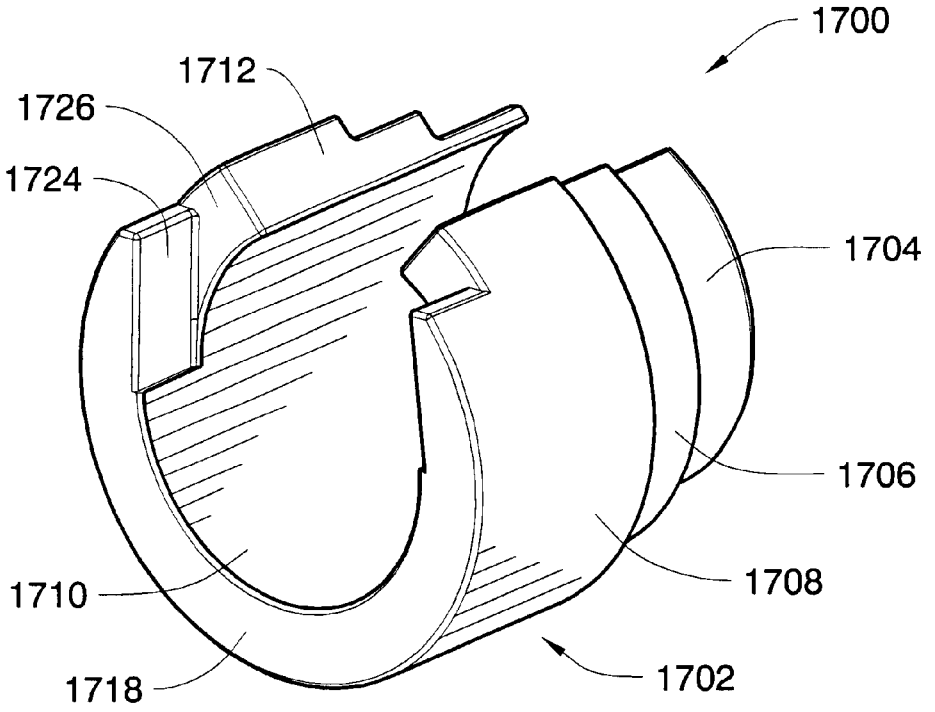
Figure 19A:
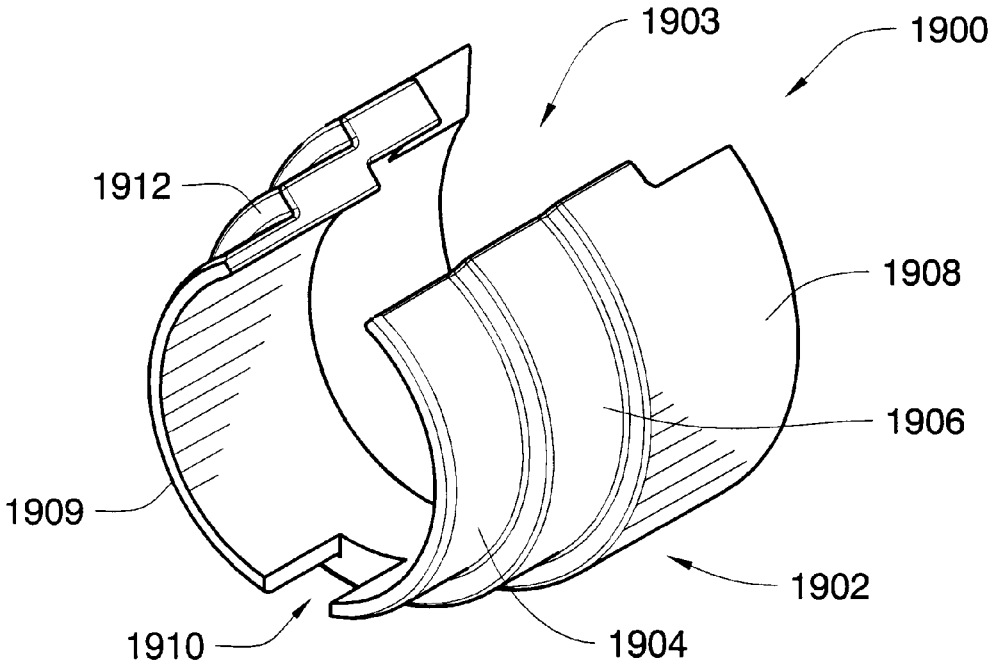
FIGS. 19*a* and 19*b* (collectively referred to as FIG. 19) are front and rear perspective views, respectively, of a second rear adapter for the fore-stocks of FIGS. 1*c* and 1*d*
Figure 21A:
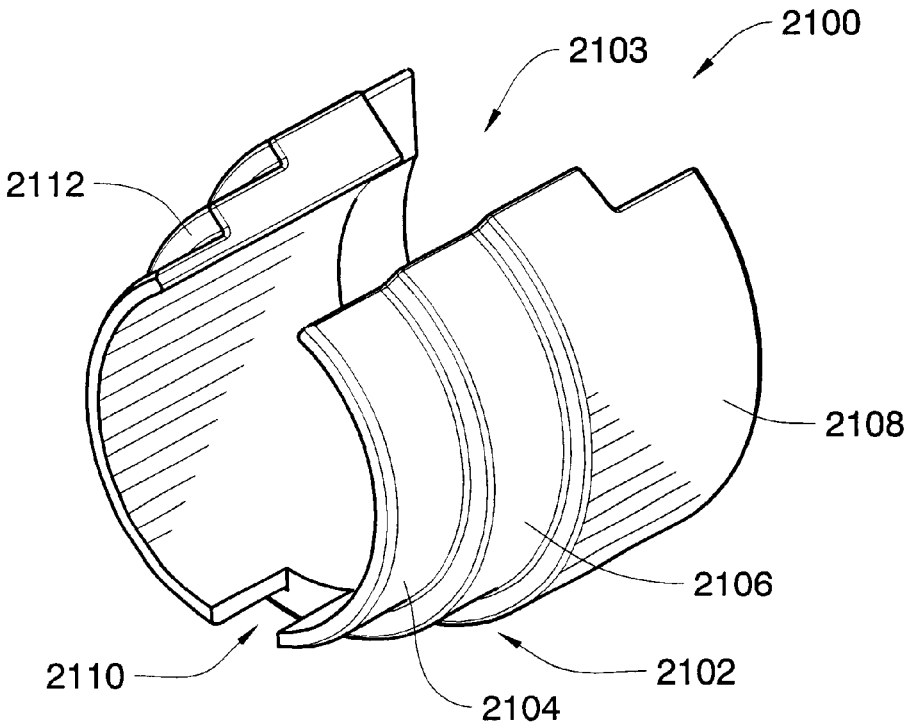
FIGS. 21*a* and 21*b* (collectively referred to as FIG. 21) are front and rear perspective views, respectively, of a third rear adapter for the fore-stocks of FIGS. 1*c* and 1*d*

Referring to FIGS. 17*a*, 19*a*, and 21*a*, rear adapter front portions 1706, 1906, and 2106, each comprise a reduced exterior diameter portion (exterior recess) configured to be closely received in recess 1402; the exterior diameter of portions 1706, 1906, and 2106 correspond to the interior diameter of fore-stock 150, 180 in recess 1402. Each of front portions 1706, 1906, and 2106, includes slot 1710, 1910, and 2110 configured to receive key 1304 and disposed opposite (180 degrees from) the center of longitudinal slot (1703, 1903, 2103) such that, when key 1404 is received in slot 1710, 1910, or 2110, the longitudinal slot (1703, 1903, 2103) is aligned with slot 1206 of fore-stock 1200. Portions 1706, 1906, and 2106 terminate in rear walls 1712, 1912, and 2112, respectively, the axial length corresponding to that of recess 1402.

As noted above, the configuration of rear adapter rear portions 1708, 1908, 2108 correspond to the configuration of the associated receiver e.g., action bars 66. Referring briefly to FIG. 12, action bars 66 couple slide 64 to the internal mechanism of receiver 50. The action bars 66 employed with most standard receivers are generally flat metal rails extending just above and parallel to receiver magazine 60, with a generally flat front end 1229. Action bars 66 are typically interconnected and secured, e.g., by welding, to slide 64. The precise manner, and configuration and features of the coupling mechanism employed in the various receiver configurations tends to vary. In some cases, a generally U-shaped coupling member 1230, disposed partly circumscribing the rear end of slide 64, is employed (having a front sidewall 1232). The precise configuration and features of coupling member 1230 employed in the various receiver configurations also tends to vary. In general, rear portions 1708, 1908, 2108 are configured to cooperate with action bars 66 and the particular coupling mechanism, e.g., coupling member 1230, of the associated receiver 50. Corresponding accommodation features are included in rear portions 1708, 1908, 2108 for any features, e.g., protrusions, flats, etc. included in the particular coupling mechanism employed by the associated receiver.

Figure 19B:
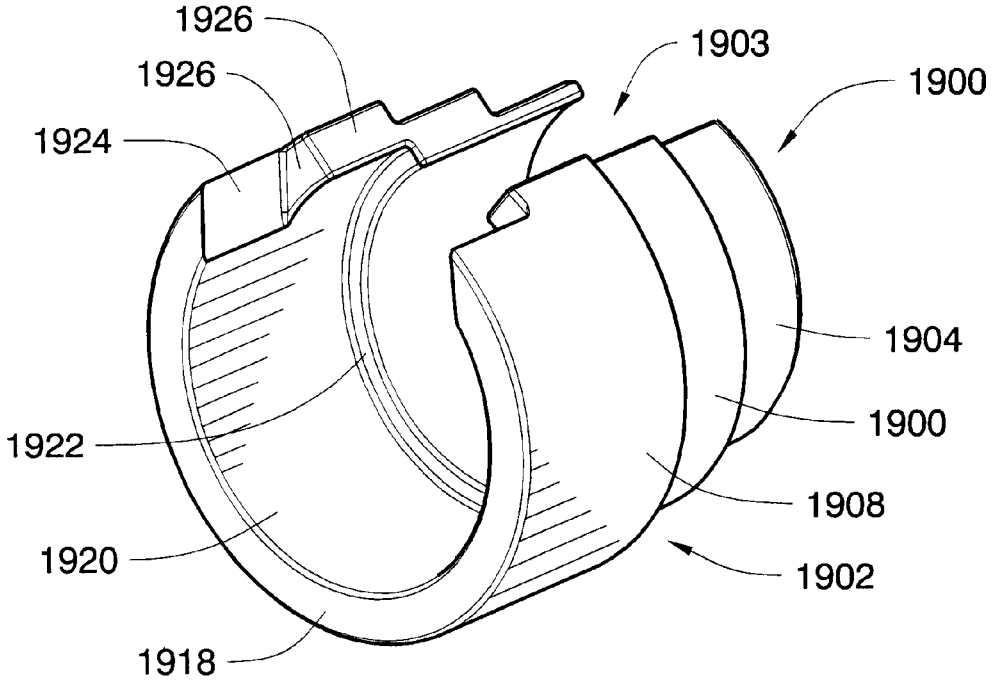
Figure 21B:
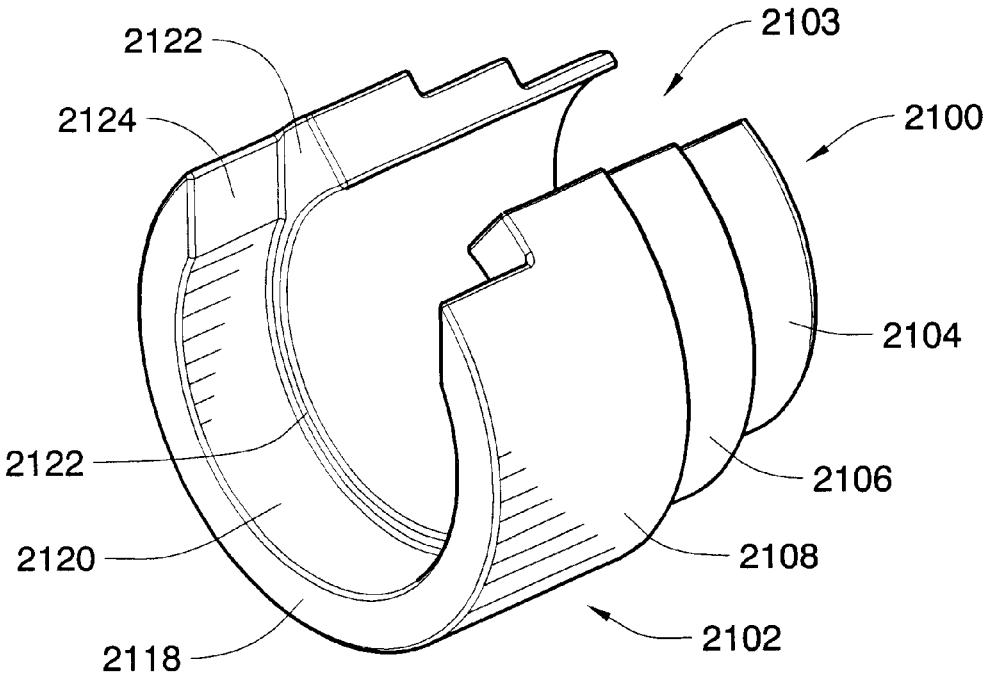

For example, Winchester and Remington pump shotguns typically employ a generally U-shaped coupling member 1230 (having a front sidewall 1232) to couple action bars 66 to slide 64. Referring to FIGS. 19*b*, and 21*b*, rear adapters 1900, and 2100, associated with, e.g., Winchester, and Remington pump shotguns, respectively, include a rear portion comprising an increased interior diameter (ID) portion (interior recess) 1920 and 2120, respectively, configured to receive the coupling member 1230 of the corresponding receiver. The recess (1920, 2120) suitably extends inwardly from the rear shoulder (1918, 2118) of the adapter to a terminating interior shoulder (1922, 2122). The axial extent (distance from the front shoulder to terminating shoulder) of the increased ID portion suitably corresponds to that of coupling member 1230 of the associated receiver 50. In addition, the configuration of an end portion of the longitudinal slot (1903, 2103), is modified, e.g., widened, and provided with generally vertical sides (1924, 2124) to accommodate action bars 66 (and coupling mechanism 1230 in the vicinity thereof). In the case of, e.g., a Winchester receiver, coupling member 1230 extends beyond (forward of) action bars 66. Accordingly, recess 1920 extends forward of the modified portion of slot 1903, i.e. vertical sides 1924 terminate at a interior shoulder 1926 to the rear of interior shoulder 1922. When assembled on slide 64, the interior shoulder (1922, 2122) of the adapter abuts front sidewall 1232 of coupling member 1230 (and, in the case of the Remington receiver, the front ends 1229 of action bars 66), the vertical sides (1924, 2124) of the end portion of longitudinal slot are positioned adjacent the sidewalls of action bars 66, and, in the case of the Winchester receiver, shoulder 1926 abuts the front ends 1229 of action bars 66.

Conversely, in the case of, e.g., Mossberg shotgun receivers action bars 66 are coupled to slide 64 at the top of slide 64, without employing any coupling member disposed such that it would need to be accommodated by a rear adapter, e.g., action bars 66 are welded, pinned or otherwise integral to slide 64. Accordingly, referring to FIG. 17*b*, adapter 1700 does not include an internal recess at the end thereof. However, the configuration of an end portion of longitudinal slot 1703, is modified, e.g., widened, and provided with generally vertical sides 1724, terminating at a interior shoulder 1926 to accommodate action bars 66 (and any coupling mechanism in the vicinity thereof). When assembled on slide 64, the front ends 1229 of action bars 66), the vertical sides 1724 of the end portion of longitudinal slot 1703 are positioned adjacent the sidewalls of action bars 66, and, shoulder 1726 abuts the front ends 1229 of action bars 66.

In each instance, rotation of the rear adapter (1700, 1900, 2100) relative to the receiver is suitably prevented by interaction of the vertical sides (1724, 1924, 2124) of the end portion of the longitudinal slot (1703, 1903, 2103) with the sides of action bars 66. The cooperation of the rear adapter front portion slot (1710, 1910, 2110) and front adapter rear portion slot (1505, 1605, 1805, 2005) with keys 1404 and 1304 of four end 1200 thus prevent fore-stock 1200 from rotating with respect to the front (1500, 1600, 1800, 2000) and rear (1700, 1900, 2100) adapters.

The intermediate (transition) portion (1706, 1906, 2106) of rear adapters (1700, 1900, 2100) may manifest any configuration that transitions from the outer diameter at the periphery of the shoulder (1712, 1912, 2112) terminating the adapter first portion (1704, 1904, 2104) to the greater outer diameter of the rear portion (1708, 1908, 2108). For example, the intermediate portion (1706, 1906, 2106) can be of constant outer diameter, preferably greater than or equal to the outer diameter of the rear portion (1708, 1908, 2108), can comprise a plurality of constant outer diameter steps, the outer diameter increasing in steps to the outer diameter of the rear portion (1708, 1908, 2108), or can change in accordance with a continuous function.

Figure 22A:
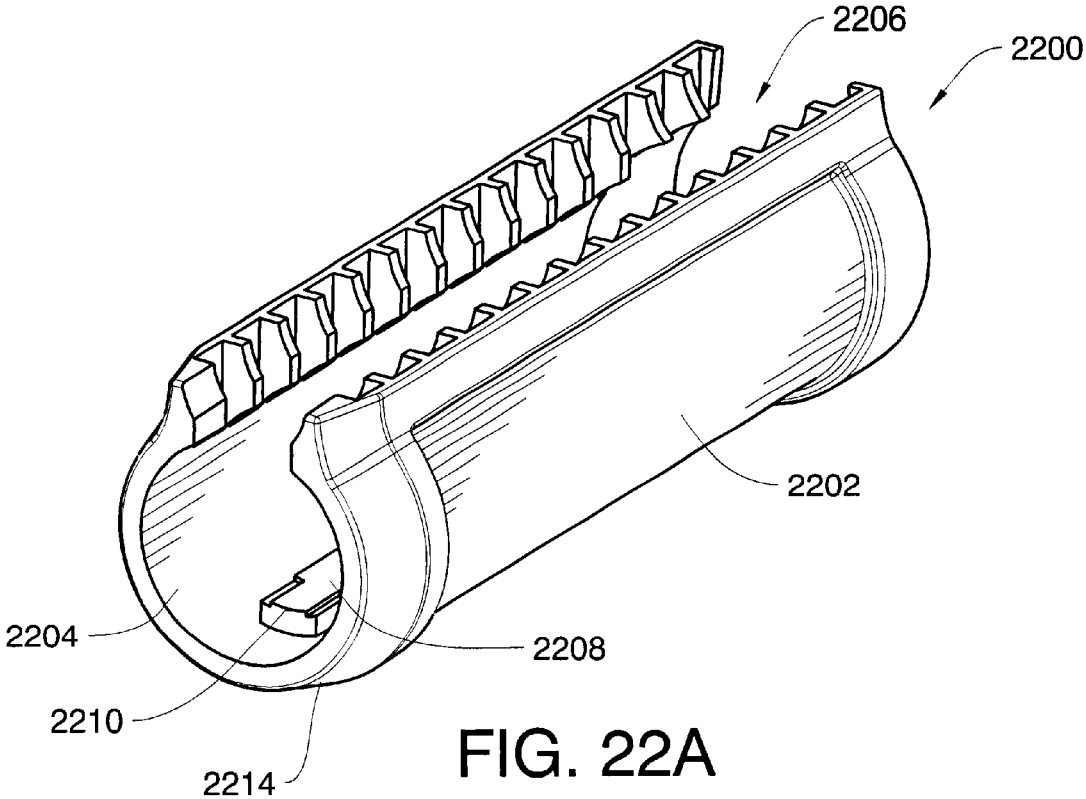
FIGS. 22*a* and 22*b* (collectively referred to as FIG. 22) are front and rear perspective views, respectively, of the standard fore-stock of FIG. 1*c*.
Figure 22B:
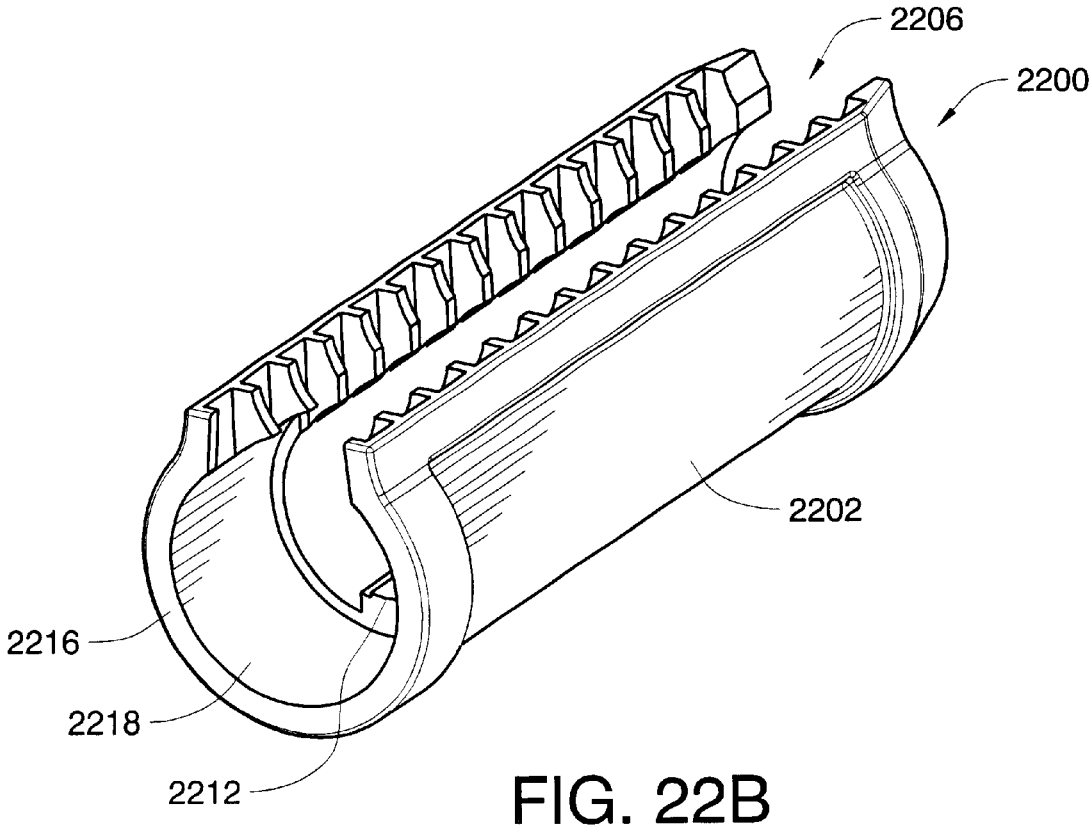

Referring now to FIG. 22, standard fore-stock 2200 comprises: a generally tubular body 2202 with front and rear edges 2214 and 2216, and a predetermined interior diameter defining a hollow interior 2204; an open longitudinal slot 2206; respective projecting keys 2210 and 2212; and an increased interior diameter (ID) section 2218, adjacent rear edge 2216. The outer diameter of body 2202 is suitably somewhat larger than the outer diameter of the body of pistol grip fore-stock 1200, e.g., in the range of 1.5 to 2 inches.

Fore-stock 2200 is preferably configured to employ the same set of adapters as pistol grip fore-stock 1200. In general, the majority of front adapters, e.g., adapters 1600, 1800 and 2000 and the majority of rear adapters, e.g., adapters e.g., 1700, 1900, and 2100, are preferably received entirely within interior 2204. However, in order to accommodate certain receiver configurations, e.g., the old style (long magazine) Mossberg, certain front adapters e.g., 1500, may in part extend beyond front edge 2214 of four end 2200 when fully engaged. The interior diameter of body 2202 is suitably approximately equal to (slightly greater than) the outer diameter of the front adapters (1500, 1600, 1800, 2000), such that the front adapter can be received within the front portion of the interior of body 2200. Increased ID section 2218 manifests predetermined ID, preferably corresponding to the outer diameter of the rear portion (1708, 1908, 2108) of the rear adapters (1700, 1900, 2100) and suitably extends inwardly a predetermined distance from rear edge 2216, preferably corresponding to the axial extent of the rear (1708, 1908, 2108) and intermediate portions (1706, 1906, 2106) of the rear adapters (1700, 1900, 2100). Keys 2210 and 2212, corresponding to keys 1304 and 1404 of pistol grip fore-stock 1200, are suitably disposed and configured to cooperate with the rear portion slot (1505, 1605, 1805, 2005) of the front adapter (1500, 1600, 1800, 2000) and the front portion slot (1710, 1910, 2110) of the rear adapter, respectively, when the front and rear adapters are fully engaged in interior 2204. Key 2210 is set back from the front edge 2214 by a predetermined distance, e.g., approximately equal to the typical distance from the rear wall (1606, 1806, 2006) of the exterior diameter portions (1604, 1804, 2004) to the front surface (1610, 1810, 2010) of the majority of front adapters (1600, 1800, 2000). Similarly, key 2212 is disposed set back from rear edge 2216 by a predetermined distance, e.g., approximately equal to the typical distance from the rear wall (1712, 1912, and 2112) of the reduced exterior diameter portions (1704, 1904, 2104) of the rear adapters (1700, 1900, 2100) to the rear surface (1718, 1918, and 2018) of the rear adapters, and preferably at the edge of increased ID section 2218.

Keys 2210 and 2212 are disposed opposite (180 degrees from) the center of longitudinal slot 2206 such that, when the front (1500, 1600, 1800, 2000) and rear (1700, 1900, 2100) adapters are disposed within interior 1204 with keys 2210 and 2212 received in the adapter reduced exterior portion slots (1505, 1605, 1805, 2005; 1710, 1910, 2110), the adapter longitudinal slot (1505, 1605, 1805, 2005; 1703, 1903, 2103) is aligned with slot 2206 of fore-stock 2200. If desired, keys 2210 and 2212 may comprise opposing ends of a single structure e.g., rectangular bar projection running longitudinally along the bottom of interior 2204.

If desired, strengthening ribs can be provided along the the edges of longitudinal slot 2206. In any event, the rear end of slot 2206 is appropriately contoured to avoid interference with the features of the connecting mechanism between action bars 66 and slide 64 in the various receiver configurations.

The foregoing is a description of preferred exemplary embodiments and best mode of the invention known to the applicant at the time of filing the application. The invention is not limited to the specific forms shown. For example, modifications may be made in the design and arrangement of the elements within the scope of the invention, as expressed in the appended claims.

What is claimed is:

1. An adapter kit for mounting a stock on a firearm receiver, the receiver including a trigger and a rear surface having any one of a plurality of different configurations disposed to the rear of the trigger, the kit comprising:

at least one of a rear stock and a fore-stock;

each rear stock, if any, including a forward portion having a predetermined configuration and having associated therewith at least one front adapter including a rearward portion conforming to the stock forward portion predetermined configuration and a forward portion conforming to an associated one of the plurality of different receiver configurations, such that, when the rear stock is disposed with the stock for ward portion adjacent the rearward portion of the adapter, and the adapter forward portion is disposed adjacent the rear surface of a receiver of the configuration associated with the adapter, the relative disposition of the rear stock and receiver is in accordance with predetermined design parameters;

each fore-stock, if any, including a forward portion having a predetermined configuration and a rear portion having a predetermined configuration, and at least one set of front and rear fore stock adapters, the front fore stock adapter including a rearward portion conforming to the fore stock forward portion predetermined configuration and a forward portion conforming to an associated one of the plurality of different receiver configurations, and the rear fore stock adapter including a forward portion conforming to the fore stock rear portion predetermined configuration and a rearward portion conforming to the associated receiver configuration;

wherein the kit includes the rear stock and, wherein the plurality of different receiver rear surface configurations include:

a first configuration, including:

a generally flat rear surface disposed a first predetermined distance rearward of the receiver trigger, the rear surface having a first predetermined peripheral shape, a recess, an outward going projection, and a receptacle disposed a first predetermined downward distance from the top of the rear surface; and a elongated fastener configured for engagement in the receptacle, for securing a stock to the receiver, the elongated fastener, when sufficiently engaged to secure the receiver to the stock, having a first predetermined extension to the rear of the receiver rear surface;

a second configuration including:

a rear surface comprising two generally planar surfaces angling forward from the top and bottom to intersect along a line, the top and bottom disposed a second predetermined distance rearward of the receiver trigger, the second predetermined distance being no greater than the first predetermined distance, the rear surface having a second predetermined peripheral shape and a receptacle disposed a second predetermined downward distance from the top of the rear surface;

a elongated fastener, configured for engagement in the receptacle, for securing a stock to the receiver, the elongated fastener, when sufficiently engaged to secure the receiver to the stock, having a second predetermined extension to the rear of the receiver rear surface, the second predetermined extension being greater than the first predetermined extension; and a third configuration including:

a generally flat rear surface disposed a third predetermined distance rearward of the receiver trigger, the third predetermined distance being no greater than the first predetermined distance, the rear surface having a third predetermined peripheral shape, a recess, an outward going projection, and a receptacle disposed a third predetermined downward distance from the top of the rear surface; and a elongated fastener configured for engagement in the receptacle, for securing a stock to the receiver, the elongated fastener, when sufficiently engaged to secure the receiver to the stock, having a third predetermined extension to the rear of the receiver rear surface; the third predetermined extension being greater than the second predetermined extension.

2. The kit of claim 1 wherein the rear stock forward portion predetermined configuration conforms to the first receiver configuration, and the kit includes a first front adapter including a rearward portion conforming to the stock forward portion predetermined configuration and a forward portion conforming to the second receiver configuration, and a second front adapter including a rearward portion conforming to the stock forward portion predetermined configuration and a forward portion conforming to the third receiver configuration.

3. The kit of claim 1 wherein: the first predetermined peripheral shape is generally rectangular with a rounded top, a flat bottom with chamfered bottom comers; the recess is annular; the receptacle is a threaded hole; the rounded top, annular recess, and threaded hole are generally concentric; and the outward going projection extends along the vertical from the top of the anular recess to the flat bottom.

4. The kit of claim 1 wherein: the second predetermined peripheral shape is generally rectangular with a rounded top, and a generally flat bottom, with rounded comers, and the receptacle for receiving the elongated fastener is disposed in the center of the line along which the planar surfaces intersect.

5. The kit of claim 1 wherein the second predetermined distance is less than than the first predetermined distance.

6. The kit of claim 1 wherein the third predetermined distance is less than than the second predetermined distance.

7. The kit of claim 1 wherein the third peripheral shape is generally the same as the first peripheral shape, of substantially the same width, but of greater height.

8. The kit of claim 1 wherein the recess of the third configuration generally conforms in shape to the third peripheral shape.

9. An adapter kit for mounting a stock on a firearm receiver, the receiver including a trigger and a rear surface having any one of a plurality of different configurations disposed to the rear of the trigger, the kit comprising:

at least one of a rear stock and a fore-stock;

each rear stock, if any, including a forward portion having a predetermined configuration and having associated therewith at least one front adapter including a rearward portion conforming to the stock forward portion predetermined configuration and a forward portion conforming to an associated one of the plurality of different receiver configurations, such that, when the rear stock is disposed with the stock forward portion adjacent the rearward portion of the adapter, and the adapter forward portion is disposed adjacent the rear surface of a receiver of the configuration associated with the adapter, the relative disposition of the rear stock and receiver is in accordance with predetermined design parameters;

each fore-stock, if any, including a forward portion having a predetermined configuration and a rear portion having a predetermined configuration, and at least one set of front and rear fore stock adapters, the front fore stock adapter including a rearward portion conforming to the fore stock forward portion predetermined configuration and a forward portion conforming to an associated one of the plurality of different receiver configurations, and the rear fore stock adapter including a forward portion conforming to the fore stock rear portion predetermined configuration and a rearward portion conforming to the associated receiver configuration;

wherein the kit includes the rear stock selected from the set consisting of a buttstock and a pistol grip rear stock.

10. The kit of claim 9 including a buttstock wherein the predetermined design parameters comprise finger pull, shoulder pull, and drop.

11. An adapter kit for mounting a stock on a firearm receiver, the receiver including a trigger and a rear surface having any one of a plurality of different configurations disposed to the rear of the trigger, the kit comprising:

at least one of a rear stock and a fore-stock;

each rear stock, if any, including a forward portion having a predetermined configuration and having associated therewith at least one front adapter including a rearward portion conforming to the stock forward portion predetermined configuration and a forward portion conforming to an associated one of the plurality of different receiver configurations, such that, when the rear stock is disposed with the stock forward portion adjacent the rearward portion of the adapter, and the adapter forward portion is disposed adjacent the rear surface of a receiver of the configuration associated with the adapter, the relative disposition of the rear stock and receiver is in accordance with predetermined design parameters;

each fore-stock, if any, including a forward portion having a predetermined configuration and a rear portion having a predetermined configuration, and at least one set of front and rear fore stock adapters, the front fore stock adapter including a rearward portion conforming to the fore stock forward portion predetermined configuration and a forward portion conforming to an associated one of the plurality of different receiver configurations, and the rear fore stock adapter including a forward portion conforming to the fore stock rear portion predetermined configuration and a rearward portion conforming to the associated receiver configuration;

wherein the receiver includes a fastening mechanism for securing a buttstock thereto, the fastening mechanism of at least some of the respective configurations varying as to at least one of the length, disposition and angle of fastening mechanism, and the kit includes a buttstock and means for securely fastening the buttstock to the receiver using the fastening mechanism of the receiver irrespective of the variations in the fastening mechanisms of the plurality of receiver configurations.

12. An adapter kit for mounting a stock on a firearm receiver, the receiver including a trigger and a rear surface having any one of a plurality of different configurations disposed to the rear of the trigger, the kit comprising:

at least one of a rear stock and a fore-stock;

each rear stock, if any, including a forward portion having a predetermined configuration and having associated therewith at least one front adapter including a rearward portion conforming to the stock forward portion predetermined configuration and a forward portion conforming to an associated one of the plurality of different receiver configurations, such that, when the rear stock is disposed with the stock forward portion adjacent the rearward portion of the adapter, and the adapter forward portion is disposed adjacent the rear surface of a receiver of the configuration associated with the adapter, the relative disposition of the rear stock and receiver is in accordance with predetermined design parameters;

each fore-stock, if any, including a forward portion having a predetermined configuration and a rear portion having a predetermined configuration, and at least one set of front and rear fore stock adapters, the front fore stock adapter including a rearward portion conforming to the fore stock forward portion predetermined configuration and a forward portion conforming to an associated one of the plurality of different receiver configurations, and the rear fore stock adapter including a forward portion conforming to the fore stock rear portion predetermined configuration and a rearward portion conforming to the associated receiver configuration;

wherein the kit includes at least one fore stock, a predetermined number of different front fore stock adapters, and a predetermined number of different rear fore stock adapters, respective combinations of rear adapters and front adapters corresponding to respective receiver configurations.

13. The kit of claim 12 wherein the firearm is a pump shotgun, and the receiver includes a forward extending magazine, a removable end nut; a cocking slide, and respective action bars, at least some of the respective configurations varying as to at least one of the slide diameter, slide length rail configuration, and end nut configuration.

14. The kit of claim 13, wherein the kit includes 4 different fore stock front adapters, three different fore stock rear adapters.

15. An adapter kit for mounting a rear stock on a firearm receiver, the receiver including a trigger and a rear surface having any one of a plurality of different configurations disposed to the rear of the trigger, the rear stock including a forward portion having a predetermined configuration, the kit comprising:

at least one front adapter including a rearward portion conforming to the stock forward portion predetermined-configuration and a forward portion conforming to an associated one of the plurality of different receiver configurations, such that, when the rear stock is disposed with the stock forward portion adjacent the rearward portion of the adapter, and the adapter forward portion is disposed adjacent the rear surface of a receiver of the configuration associated with the adapter, the relative disposition of the rear stock and receiver is in accordance with predetermined design parameters.

16. The kit of claim 15, comprising:

first and second front adapters, each including a rearward portion conforming to the stock forward portion predetermined configuration and a forward portion conforming to an associated one of the plurality of different receiver configurations;

the forward portion of the first front adapter, including:

a generally flat surface, with a peripheral recess, the recess having a rear wall and side walls a passageway opening in the flat surface; and a slot formed through side walls and rear wall of the recess the forward portion of the second front adapter, including:

a front surface, effectively defined by two planes intersecting along a line;

a passageway having opening disposed on the line of intersection.

17. The kit of claim 15, wherein the plurality of different receiver rear surface configurations include:

a first configuration, including:

a generally flat rear surface disposed a first predetermined distance rearward of the receiver trigger, the rear surface having a first predetermined peripheral shape, a recess, an outward going projection, and a receptacle disposed a first predetermined downward distance from the top of the rear surface; and a elongated fastener configured for engagement in the receptacle, for securing a stock to the receiver, the elongated fastener, when sufficiently engaged to secure the receiver to the stock, having a first predetermined extension to the rear of the receiver rear surface;

a second configuration including:

a rear surface comprising two generally planar surfaces angling forward from the top and bottom to intersect along a line, the top and bottom disposed a second predetermined distance rearward of the receiver trigger, the second predetermined distance being no greater than the first predetermined distance, the rear surface having a second predetermined peripheral shape and a receptacle disposed a second predetermined downward distance from the top of the rear surface;

a elongated fastener, configured for engagement in the receptacle, for securing a stock to the receiver, the elongated fastener, when sufficiently engaged to secure the receiver to the stock, having a second predetermined extension to the rear of the receiver rear surface, the second predetermined extension being greater than the first predetermined extension; and a third configuration including:

a generally flat rear surface disposed a third predetermined distance rearward of the receiver trigger, the third predetermined distance being no greater than the first predetermined distance, the rear surface having a third predetermined peripheral shape, a recess, an outward going projection, and a receptacle disposed a third predetermined downward distance from the top of the rear surface; and a elongated fastener configured for engagement in the receptacle, for securing a stock to the receiver, the elongated fastener, when sufficiently engaged to secure the receiver to the stock, having a third predetermined extension to the rear of the receiver rear surface; the third predetermined extension being greater than the second predetermined extension.

18. The kit of claim 17 wherein: the first predetermined peripheral shape is generally rectangular with a rounded top, a flat bottom with chamfered bottom corners; the recess is annular; the receptacle is a threaded hole; the rounded top, annular recess, and threaded hole are generally concentric; and the outward going projection extends along the vertical from the top of the annular recess to the flat bottom.

19. The kit of claim 17 wherein: the second predetermined peripheral shape is generally rectangular with a rounded top, and a generally flat bottom, with rounded comers, and the receptacle for receiving the elongated fastener is disposed in the center of the line along which the planar surfaces intersect.

20. The kit of claim 17 wherein the second predetermined distance is less than than the first predetermined distance.

21. The kit of claim 17 wherein the third predetermined distance is less than than the second predetermined distance.

22. The kit of claim 17 wherein the third peripheral shape is generally the same as the first peripheral shape, of substantially the same width, but of greater height.

23. The kit of claim 17 wherein the recess of the third shape generally conforms in shape to the third peripheral shape.

24. An adaptor kit for mounting a stock on one of a plurality of differently configured firearm receivers, the kit comprising:

at least one of a rear stock and a fore-stock, and a plurality of adaptor means for interchangeably mounting the at least one of the rear stock and the fore-stock to any one the plurality of differently configured firearm receivers.

25. The adaptor kit of claim 24 wherein the adaptor means are configured to conform to shoulder pull, finger pull and drop design parameters of respective firearms of the plurality of differently configured firearm receivers.

* * * * *